US009353765B2

(12) United States Patent
Haley et al.

(10) Patent No.: US 9,353,765 B2
(45) Date of Patent: May 31, 2016

(54) CENTRIFUGAL COMPRESSOR ASSEMBLY AND METHOD

(75) Inventors: Paul F. Haley, Coon Valley, WI (US); Rick T. James, La Crescent, MN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 1156 days.

(21) Appl. No.: 12/034,594

(22) Filed: Feb. 20, 2008

(65) Prior Publication Data

US 2009/0208331 A1 Aug. 20, 2009

(51) Int. Cl.
*F04D 27/02* (2006.01)
*F04D 29/42* (2006.01)
(Continued)

(52) U.S. Cl.
CPC ..... *F04D 29/4213* (2013.01); *F04D 29/462* (2013.01); *F05D 2250/51* (2013.01); *F25B 1/053* (2013.01)

(58) Field of Classification Search
CPC ..... F04D 1/00; F04D 7/00; F04D 7/02; F04D 15/0038; F04D 27/002; F04D 27/003; F04D 29/44; F04D 29/441; F04D 29/46; F04D 29/462; F04D 29/4213; F25B 1/053; F05D 2250/57
USPC ..... 415/142, 159, 160, 161, 191, 192, 193, 415/183, 185, 208.2, 209.1, 208.3, 208.4, 1
See application file for complete search history.

(56) References Cited

U.S. PATENT DOCUMENTS 1,945,071 A 1/1934 Popp
2,285,976 A 6/1942 Huitson
(Continued)

FOREIGN PATENT DOCUMENTS

CN 2536821 Y 2/2003
CN 2769561 Y 4/2006
(Continued)

OTHER PUBLICATIONS

The State Intellectual Property Office of the People's Republic of China, Notice on the First Office Action in Chinese application No. 200980106070.2 and translation, dated Dec. 23, 2011 (13 pages).
(Continued)

*Primary Examiner* — Dwayne J White
*Assistant Examiner* — Joshua R Beebe
(74) *Attorney, Agent, or Firm* — Hamre, Schumann, Mueller & Larson, P.C.

(57) ABSTRACT

A centrifugal compressor assembly for compressing refrigerant in a 250-ton capacity or larger chiller system comprising a motor, preferably a compact, high energy density motor or permanent magnet motor, for driving a shaft at a range of sustained operating speeds under the control of a variable speed drive. Another embodiment of the centrifugal compressor assembly comprises a mixed flow impeller and a vaneless diffuser sized such that a final stage compressor operates with an optimal specific speed range for targeted combinations of head and capacity, while a non-final stage compressor operates above the optimum specific speed of the final stage compressor. Another embodiment of the centrifugal compressor assembly comprises an integrated inlet flow conditioning assembly comprising a flow conditioning nose, a plurality of inlet guide vanes and a flow conditioning body that positions inlet guide vanes to condition flow of refrigerant into an impeller to achieve a target approximately constant angle swirl distribution with minimal guide vane turning.

22 Claims, 15 Drawing Sheets

(51) Int. Cl.
*F04D 29/46* (2006.01)
*F25B 1/053* (2006.01)

(56) References Cited

U.S. PATENT DOCUMENTS 2,453,524 A 11/1948 McMahan et al.
2,465,625 A 3/1949 Aue
2,641,191 A * 6/1953 Buchi ..... 415/188
2,746,269 A 5/1956 Moody
2,768,511 A 10/1956 Moody
2,770,106 A 11/1956 Moody
2,793,506 A 5/1957 Moody
2,817,475 A 12/1957 Moody
2,827,261 A 3/1958 Parker et al.
2,860,827 A 11/1958 Egli
2,986,903 A 2/1959 Kocher et al.
2,947,468 A 8/1960 Tryon
3,069,070 A 12/1962 Macaluso et al.
3,083,308 A 3/1963 Baumann
3,232,074 A 2/1966 Weller et al.
3,251,539 A * 5/1966 Wolfe et al. ..... 415/150
3,362,624 A 1/1968 Endress
3,390,837 A 7/1968 Freeman
3,700,355 A 10/1972 Anderson et al.
3,719,430 A 3/1973 Blair et al.
3,868,196 A 2/1975 Lown
3,878,112 A 4/1975 Luck et al.
3,913,346 A 10/1975 Moody et al.
3,941,506 A 3/1976 Robb et al.
3,984,193 A 10/1976 Yu
4,105,372 A 8/1978 Mishina et al.
4,141,708 A 2/1979 Lavigne, Jr. et al.
4,144,717 A 3/1979 Anderson et al.
4,159,255 A 6/1979 Gainer et al.
4,171,623 A 10/1979 Lavigne, Jr. et al.
4,212,585 A 7/1980 Swarden et al.
4,224,010 A 9/1980 Fujino
4,232,533 A 11/1980 Lundblad et al.
4,240,519 A 12/1980 Wynosky
4,265,589 A 5/1981 Watson et al.
4,271,898 A 6/1981 Freeman
4,307,995 A 12/1981 Catterfeld
4,363,596 A 12/1982 Watson et al.
4,375,939 A 3/1983 Mount et al.
4,377,074 A 3/1983 Jardine
4,379,484 A 4/1983 Lom et al.
4,404,815 A 9/1983 Gilson
4,428,715 A 1/1984 Wiggins
4,449,888 A 5/1984 Balje
4,462,539 A 7/1984 Gilson
4,478,056 A 10/1984 Michaels, Jr.
4,502,837 A 3/1985 Blair et al.
4,509,341 A 4/1985 Zimmern
4,519,539 A 5/1985 Bussjager et al.
4,523,896 A 6/1985 Lhenry et al.
4,573,324 A 3/1986 Tischer et al.
4,686,834 A 8/1987 Haley et al.
4,691,533 A 9/1987 Zimmern
4,734,628 A 3/1988 Bench et al.
4,824,323 A 4/1989 Griepentrog et al.
4,834,611 A 5/1989 Meng
4,903,497 A 2/1990 Zimmern et al.
4,982,574 A 1/1991 Morris, Jr.
5,016,448 A 5/1991 Plzak
5,048,302 A 9/1991 Hagenlocher et al.
5,095,712 A 3/1992 Narreau
5,125,806 A 6/1992 Quick et al.
5,145,317 A 9/1992 Brasz
5,167,130 A 12/1992 Morris, Jr.
5,228,832 A 7/1993 Nishida et al.
5,230,616 A 7/1993 Serizawa et al.
5,324,229 A 6/1994 Weisbecker
5,326,231 A 7/1994 Pandeya et al.
5,332,359 A * 7/1994 Palgon et al. ..... 415/182.1
5,350,039 A 9/1994 Voss et al.
5,355,691 A 10/1994 Sullivan et al.
5,362,207 A 11/1994 Martin et al.
5,445,496 A 8/1995 Brasz
5,447,037 A 9/1995 Bishop et al.
5,467,613 A 11/1995 Brasz
5,473,899 A 12/1995 Viteri et al.
5,537,830 A 7/1996 Goshaw et al.
5,553,997 A 9/1996 Goshaw et al.
5,555,956 A 9/1996 Voss et al.
5,582,022 A 12/1996 Heinrichs et al.
5,598,718 A 2/1997 Freund et al.
5,611,663 A 3/1997 Kotzur
5,620,308 A 4/1997 Yoshinari et al.
5,669,225 A 9/1997 Beaverson et al.
5,669,756 A 9/1997 Brasz et al.
5,685,696 A 11/1997 Zangeneh et al.
5,685,699 A 11/1997 Holmes et al.
5,692,389 A 12/1997 Lord et al.
5,703,421 A 12/1997 Durkin
5,709,531 A 1/1998 Nishida et al.
5,730,582 A 3/1998 Heitmann
5,795,138 A 8/1998 Gozdawa
5,797,731 A 8/1998 Kobayashi
5,845,509 A 12/1998 Shaw et al.
5,857,348 A 1/1999 Conry
5,895,204 A 4/1999 Sishtla et al.
5,996,364 A 12/1999 Lifson et al.
6,003,298 A 12/1999 Horner
6,012,897 A 1/2000 Sabnis et al.
6,015,270 A 1/2000 Roth
6,039,534 A * 3/2000 Stoner et al. ..... 415/162
6,043,580 A 3/2000 Vogel et al.
6,056,518 A 5/2000 Allen et al.
6,062,028 A 5/2000 Arnold et al.
6,065,929 A 5/2000 Morel et al.
6,066,898 A 5/2000 Jensen
6,089,839 A 7/2000 Bush et al.
6,139,262 A 10/2000 Ravidranath
6,142,753 A 11/2000 Bush et al.
6,162,033 A 12/2000 Moore, Jr. et al.
6,182,439 B1 2/2001 Siga et al.
6,183,661 B1 2/2001 Makin et al.
6,193,473 B1 2/2001 Mruk et al.
6,202,438 B1 3/2001 Barito
6,279,322 B1 8/2001 Moussa
6,293,119 B1 9/2001 Wenzel
6,293,776 B1 9/2001 Hahn et al.
6,296,441 B1 10/2001 Gozdawa
6,374,631 B1 4/2002 Lifson et al.
6,428,284 B1 8/2002 Vaisman
6,430,959 B1 8/2002 Lifson
6,434,960 B1 8/2002 Rousseau
6,474,087 B1 11/2002 Lifson
6,474,950 B1 11/2002 Waldo
6,495,929 B2 12/2002 Bosley et al.
6,505,706 B2 1/2003 Tse
6,532,754 B2 3/2003 Haley et al.
6,540,481 B2 4/2003 Moussa et al.
6,571,576 B1 6/2003 Lifson et al.
6,579,078 B2 6/2003 Hill et al.
6,591,621 B2 7/2003 Loprete et al.
6,616,421 B2 9/2003 Mruk et al.
6,624,539 B1 9/2003 Hansen et al.
6,679,057 B2 1/2004 Arnold
6,694,750 B1 2/2004 Lifson et al.
6,725,643 B1 4/2004 Paul
6,755,620 B2 6/2004 Nakamura et al.
6,834,501 B1 12/2004 Vrbas et al.
6,872,050 B2 3/2005 Nenstiel
6,874,329 B2 4/2005 Stark et al.
6,883,341 B1 4/2005 Lifson
6,895,781 B2 5/2005 Dobmeier et al.
6,941,769 B1 9/2005 Hill, IV et al.
6,973,797 B2 12/2005 Nemit, Jr.
6,994,518 B2 * 2/2006 Simon et al. ..... 415/147
6,997,686 B2 2/2006 Agrawal et al.
7,000,423 B2 2/2006 Lifson et al.
7,032,387 B2 4/2006 Germain et al.
7,044,716 B2 5/2006 Fabry

(56) References Cited

U.S. PATENT DOCUMENTS

| | | | | |
|---|---|---|---|---|
| 7,059,151 | B2 | 6/2006 | Taras et al. | |
| 7,083,379 | B2 | 8/2006 | Nikpour et al. | |
| 7,114,349 | B2 | 10/2006 | Lifson et al. | |
| 7,164,242 | B2 | 1/2007 | Federman et al. | |
| 7,181,928 | B2 | 2/2007 | de Larminat | |
| 7,189,062 | B2 | 3/2007 | Fukizawa et al. | |
| 7,208,891 | B2 | 4/2007 | Jadric et al. | |
| RE39,597 | E | 5/2007 | Rousseau | |
| 7,228,707 | B2 | 6/2007 | Lifson et al. | |
| 7,240,515 | B2 | 7/2007 | Conry | |
| 7,293,955 | B2 | 11/2007 | Lawlor et al. | |
| 7,305,762 | B2 | 12/2007 | Mola | |
| 7,789,617 | B2 | 9/2010 | Wahl et al. | |
| 8,177,498 | B2 | 5/2012 | Hermann et al. | |
| 8,231,341 | B2 | 7/2012 | Anderson et al. | |
| 2002/0014088 | A1* | 2/2002 | Seki et al. | 62/498 |
| 2002/0076336 | A1 | 6/2002 | Mruk et al. | |
| 2002/0106278 | A1 | 8/2002 | Koga | |
| 2004/0094662 | A1 | 5/2004 | Sanders et al. | |
| 2004/0179947 | A1 | 9/2004 | Agrawal et al. | |
| 2004/0261450 | A1* | 12/2004 | Yoshino | B60H 1/00571 62/513 |
| 2005/0121946 | A1 | 6/2005 | McKnight et al. | |
| 2005/0223737 | A1 | 10/2005 | Conry | |
| 2007/0065300 | A1 | 3/2007 | Mariani et al. | |
| 2007/0092372 | A1* | 4/2007 | Carroll et al. | 415/191 |
| 2007/0110596 | A1 | 5/2007 | Weeber et al. | |
| 2007/0253808 | A1* | 11/2007 | Hasan et al. | 415/119 |
| 2008/0115527 | A1 | 5/2008 | Doty et al. | |
| 2009/0123276 | A1* | 5/2009 | Greim | F01D 5/141 415/193 |
| 2010/0266395 | A1 | 10/2010 | Hermann et al. | |

FOREIGN PATENT DOCUMENTS

| | | | |
|---|---|---|---|
| CN | 1987119 | A | 6/2007 |
| DE | 821879 | C | 11/1951 |
| DE | 889091 | | 9/1953 |
| DE | 1013033 | B | 8/1957 |
| DE | 100 60 114 | | 6/2001 |
| EP | 0289140 | A2 | 11/1988 |
| EP | 0 297 691 | | 1/1989 |
| EP | 0331902 | A2 | 9/1989 |
| EP | 0420786 | A1 | 4/1991 |
| EP | 0515746 | A1 | 12/1992 |
| EP | 0719944 | A2 | 7/1996 |
| EP | 0811770 | A1 | 12/1997 |
| EP | 0 855 562 | | 7/1998 |
| EP | 0896157 | A1 | 2/1999 |
| EP | 1 217 219 | | 6/2002 |
| EP | 1 416 123 | | 5/2004 |
| EP | 1 429 032 | | 6/2004 |
| EP | 1429032 | A2 * | 6/2004 |
| EP | 1 862 749 | | 12/2007 |

OTHER PUBLICATIONS

The State Intellectual Property Office of the People's Republic of China, Notice on the First Office Action in Chinese application No. 200980106069X and translation, dated Feb. 16, 2012 (11 pages).

International Search Report and Written Opinion for International Patent Application Serial No. PCT/US2009/034612, mailed May 12, 2009.

Manczyk, H., "Refrigeration Chiller Performance Analysis at Various Loads." Online: http://www.energy.rochester.edu/efficiency/chilleranalysis.pdf. Apr. 2, 2003, pp. 1-6. XP002528251.

Yasuo Fukushima et al. "New Oilless Era for Process Compressors." Hitachi Review, vol. 41, No. 6, Jan. 1, 1993. XP 000369880.

Office Action mailed Jul. 8, 2010 for U.S. Appl. No. 12/034,551, filed Feb. 20, 2008.

Notice of Allowance and Fee(s) Due mailed Aug. 23, 2010 for U.S. Appl. No. 12/034,608, filed Feb. 20, 2008.

Non-final Office Action mailed Aug. 26, 2010 for U.S. Appl. No. 12/034,607, filed Feb. 20, 2008.

Notice of Allowance and Fee(s) Due mailed Mar. 7, 2011 for U.S. Appl. No. 12/034,551, filed Feb. 20, 2008.

Office Action mailed Mar. 21, 2011 for U.S. Appl. No. 12/034,607, filed Feb. 20, 2008.

Notice of Allowance and Fee(s) Due mailed Jun. 1, 2011 for U.S. Appl. No. 12/034,607, filed Feb. 20, 2008.

International Search Report and Written Opinion for International Patent App. Serial No. PCT/US2009/034615, mailed May 15, 2009.

International Search Report and Written Opinion for International Patent App. Serial No. PCT/US2009/034620, mailed May 18, 2009.

International Search Report and Written Opinion for International Patent App. Serial No. PCT/US2009/034624, mailed May 19, 2009.

The State Intellectual Property Office of the People's Republic of China, Notice on the Second Office Action in Chinese application No. 200980106069.X translation, dated Dec. 28, 2012 (8 pages).

The State Intellectual Property Office of the People's Republic of China, Notice on the Third Office Action in Chinese application No. 200980106069.X translation, dated Jun. 8, 2013 (25 pages).

Canadian Intellectual Property Office Requisition by the Examiner in Canadian application No. 2,712,828, dated Jun. 10, 2013 (5 pages).

Office Action issued for Chinese patent application No. 201410045232.9, dated Sep. 17, 2015 (15 pages).

* cited by examiner

CENTRIFUGAL COMPRESSOR ASSEMBLY AND METHOD

BACKGROUND OF THE INVENTION

The present invention generally pertains to compressors used to compress fluid. More particularly, embodiments of the present invention relate to a high-efficiency centrifugal compressor assembly, and components thereof, for use in a refrigeration system. An embodiment of the compressor assembly incorporates an integrated fluid flow conditioning assembly, fluid compressor elements, and a permanent magnet motor controlled by a variable speed drive.

Refrigeration systems typically incorporate a refrigeration loop to provide chilled water for cooling a designated building space. A typical refrigeration loop includes a compressor to compress refrigerant gas, a condenser to condense the compressed refrigerant to a liquid, and an evaporator that utilizes the liquid refrigerant to cool water. The chilled water is then piped to the space to be cooled.

One such refrigeration or air conditioning system uses at least one centrifugal compressor and is referred to as a centrifugal chiller. Centrifugal compression involves the purely rotational motion of only a few mechanical parts. A single centrifugal compressor chiller, sometimes called a simplex chiller, typically range in size from 100 to above 2,000 tons of refrigeration. Typically, the reliability of centrifugal chillers is high, and the maintenance requirements are low.

Centrifugal chillers consume significant energy resources in commercial and other high cooling and/or heating demand facilities. Such chillers can have operating lives of upwards of thirty years or more in some cases.

Centrifugal chillers provide certain advantages and efficiencies when used in a building, city district (e.g. multiple buildings) or college campus, for example. Such chillers are useful over a wide range of temperature applications including Middle East conditions. At lower refrigeration capacities, screw, scroll or reciprocating-type compressors are most often used in, for example, water-based chiller applications.

In prior simplex chiller systems in the range of about 100 tons to above 2000 tons, compressor assemblies have been typically gear driven by an induction motor. The components of the chiller system were designed separately, typically optimized, for given application conditions, which neglects cumulative benefits that can be gained by fluid control upstream in between and downstream of compressor stages. Further, the first stage of a prior multistage compressor used in chiller systems was sized to perform optimally, while the second (or later) stage was allowed to perform less than optimally.

BRIEF SUMMARY OF THE INVENTION

According to a preferred embodiment of the present invention, an inlet flow conditioning assembly for use in a compressor for compressing a refrigerant is provided. The inlet flow conditioning assembly comprises: an inlet flow conditioning housing positioned within the compressor and upstream of an impeller housed in the compressor; the inlet flow conditioning housing forming a flow conditioning channel having a channel inlet in fluid communication with a channel outlet; a flow conditioning body having a first body end, an intermediate portion and a second body end; said flow conditioning body being substantially centrally positioned along the length of the flow conditioning channel; the flow conditioning body coincident to a flow conditioning nose at the first body end and coincident to an impeller hub of the impeller at the second body end, said flow conditioning body having a streamline curvature with a radius relative to the axis of rotation of the impeller that exceeds the radius of the impeller hub; and a plurality of inlet guide vanes positioned between said channel inlet and channel outlet; said inlet guide vanes being rotatably mounted on a support shaft at a location along the flow conditioning body where the radius of the flow conditioning body relative to the axis of rotation of the impeller exceeds the radius of the impeller hub.

In yet a further embodiment, a method of conditioning a refrigerant swirl through a compressor having a compressor housing, said compressor for compressing a refrigerant, is provided. The method comprises the steps of: positioning an inlet flow conditioning assembly upstream of an impeller disposed within the compressor housing and drawing the refrigerant through said inlet flow conditioning assembly to the impeller during operation of the compressor. The inlet flow conditioning assembly for use in this method comprises: an inlet flow conditioning housing positioned within the compressor and upstream of the impeller housed in the compressor; the inlet flow conditioning housing forming a flow conditioning channel having a channel inlet in fluid communication with a channel outlet; a flow conditioning body having a first body end, an intermediate portion and a second body end; said flow conditioning body being substantially centrally positioned along a length of the flow conditioning channel; the flow conditioning body is arranged coincident to a flow conditioning nose at the first body end and coincident to the impeller hub of the impeller at the second body end, said flow conditioning body having a streamline curvature with a radius relative to an axis of rotation of the impeller that exceeds a radius of the impeller hub; and a plurality of inlet guide vanes positioned between said channel inlet and channel outlet, said plurality of inlet guide vanes being rotatably mounted on a support shaft at a location along the flow conditioning body where the radius relative to the axis of rotation of the impeller that exceeds the radius of the impeller hub.

Advantages of embodiments of the present invention should be apparent. For example, an embodiment is a high performance, integrated compressor assembly that can operate at practically constant full load efficiency over a wide nominal capacity range regardless of normal power supply frequency and voltage variations. A preferred compressor assembly: increases full load efficiency, yields higher part load efficiency and has practically constant efficiency over a given capacity range, controlled independently of power supply frequency or voltage changes. Additional advantages are a reduction in the physical size of the compressor assembly and chiller system, improved scalability throughout the operating range and a reduction in total sound levels. Another advantage of a preferred embodiment of the present invention is that the total number of compressors needed to perform over a preferred capacity range of about 250 to above 2,000 tons can be reduced, which can lead to a significant cost reduction for the manufacturer.

Additional advantages and features of the invention will become apparent from the description and claims which follow.

BRIEF DESCRIPTION OF THE SEVERAL VIEWS OF THE DRAWINGS

The following figures include like numerals indicating like features where possible.

DETAILED DESCRIPTION OF A PREFERRED EMBODIMENT

Figure 1:
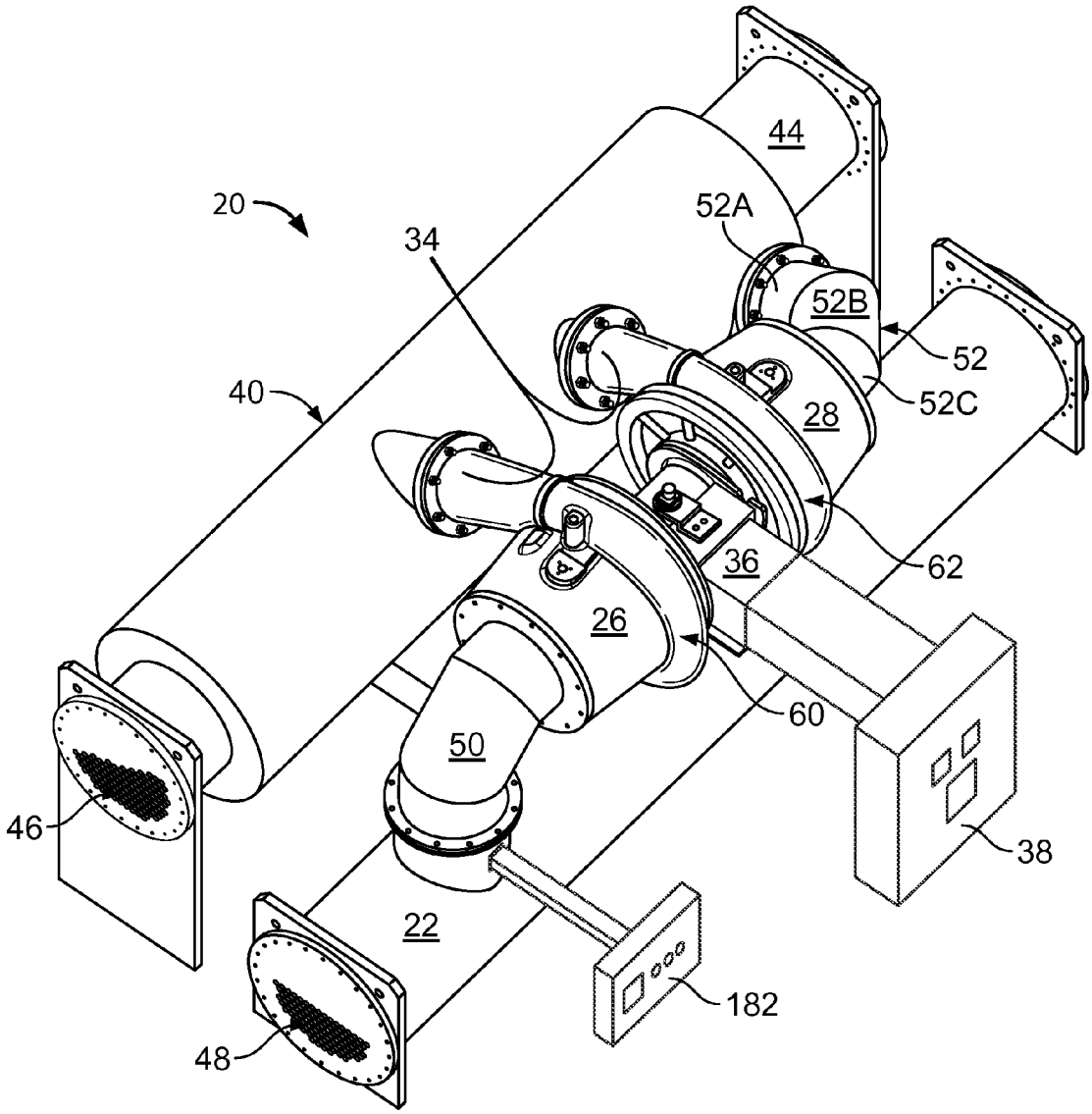
FIG. 1 illustrates a perspective view of a chiller system and the various components according to an embodiment of the present invention.
Figure 2:
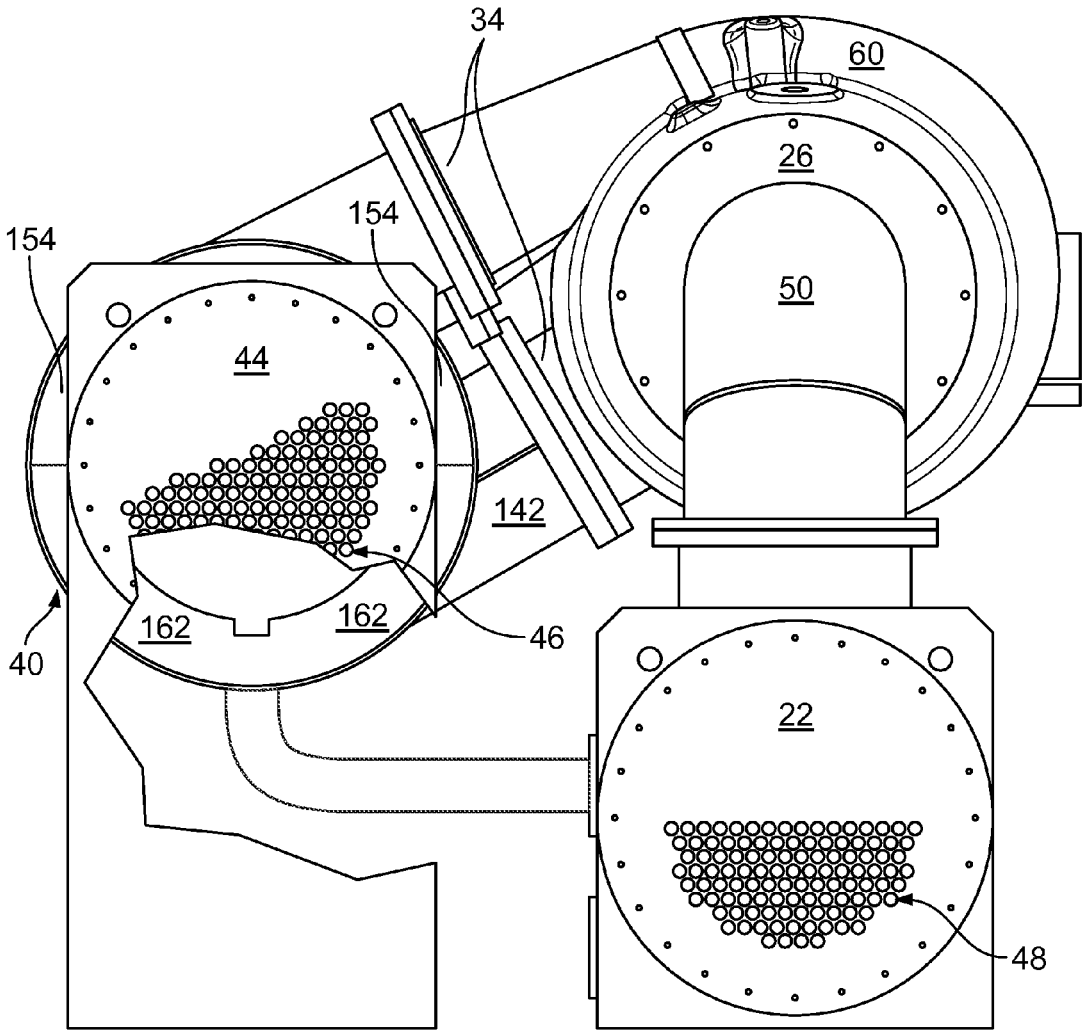
FIG. 2 illustrates an end, cut away view of a chiller system showing tubing arrangements for the condenser and evaporator according to an embodiment of the present invention.
Figure 3:
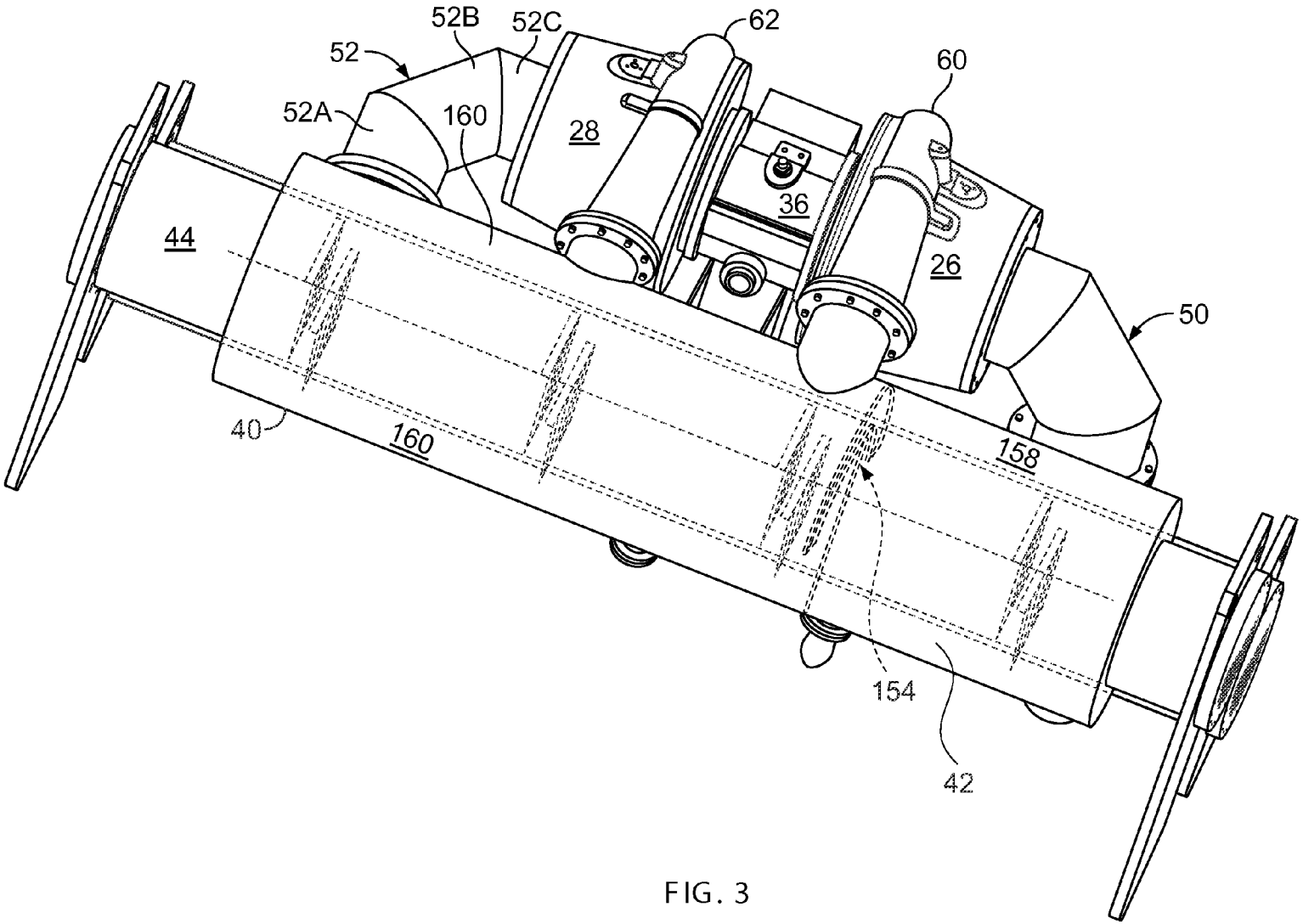
FIG. 3 illustrates another perspective view of a chiller system according to an embodiment of the present invention.

Referring to FIGS. 1-3 of the drawings, a chiller or chiller system 20 for a refrigeration system. A single centrifugal chiller system, and the basic components of chiller 20 are illustrated in FIGS. 1-3. The chiller 20 includes many other conventional features not depicted for simplicity of the drawings. In addition, as a preface to the detailed description, it should be noted that, as used in this specification and the appended claims, the singular forms "a," "an," and "the" include plural referents, unless the context clearly dictates otherwise.

In the embodiment depicted, chiller 20 is comprised of an evaporator 22, multi-stage compressor 24 having a non-final stage compressor 26 and a final stage compressor 28 driven by a variable speed, direct drive permanent magnet motor 36, and a coaxial economizer 40 with a condenser 44. The chiller 20 is directed to relatively large tonnage centrifugal chillers in the range of about 250 to 2000 tons or larger.

In a preferred embodiment, the compressor stage nomenclature indicates that there are multiple distinct stages of gas compression within the chiller's compressor portion. While a multi-stage compressor 24 is described below as a two-stage configuration in a preferred embodiment, persons of ordinary skill in this art will readily understand that embodiments and features of this invention are contemplated to include and apply to, not only two-stage compressors/chillers, but to single stage and other multiple stage compressors/chillers, whether in series or in parallel.

Referring to FIGS. 1-2, for example, preferred evaporator 22 is shown as a shell and tube type. Such evaporators can be of the flooded type. The evaporator 22 may be of other known types and can be arranged as a single evaporator or multiple evaporators in series or parallel, e.g. connecting a separate evaporator to each compressor. As explained further below, the evaporator 22 may also be arranged coaxially with an economizer 42. The evaporator 22 can be fabricated from carbon steel and/or other suitable material, including copper alloy heat transfer tubing.

A refrigerant in the evaporator 22 performs a cooling function. In the evaporator 22, a heat exchange process occurs, where liquid refrigerant changes state by evaporating into a vapor. This change of state, and any superheating of the refrigerant vapor, causes a cooling effect that cools liquid (typically water) passing through the evaporator tubing 48 in the evaporator 22. The evaporator tubing 48 contained in the evaporator 22 can be of various diameters and thicknesses and comprised typically of copper alloy. The tubes may be replaceable, are mechanically expanded into tube sheets, and externally finned seamless tubing.

The chilled or heated water is pumped from the evaporator 22 to an air handling unit (not shown). Air from the space that is being temperature conditioned is drawn across coils in the air handling unit that contains, in the case of air conditioning, chilled water. The drawn-in air is cooled. The cool air is then forced through the air conditioned space, which cools the space.

Also, during the heat exchange process occurring in the evaporator 22, the refrigerant vaporizes and is directed as a lower pressure (relative to the stage discharge) gas through a non-final stage suction inlet pipe 50 to the non-final stage compressor 26. Non-final stage suction inlet pipe 50 can be, for example, a continuous elbow or a multi-piece elbow.

A three-piece elbow is depicted in an embodiment of non-final stage suction inlet pipe 50 in FIGS. 1-3, for example. The inside diameter of the non-final stage suction inlet pipe 50 is sized such that it minimizes the risk of liquid refrigerant droplets being drawn into the non-final stage compressor 26. For example, the inside diameter of the non-final stage suction inlet pipe 50 can be sized based on, among things, a limit velocity of 60 feet per second for a target mass flow rate, the refrigerant temperature and a three-piece elbow configuration. In the case of the multi-piece non-final stage suction inlet pipe 50, the lengths of each pipe piece can also be sized for a shorter exit section to, for example, minimize corner vortex development.

Figure 13:
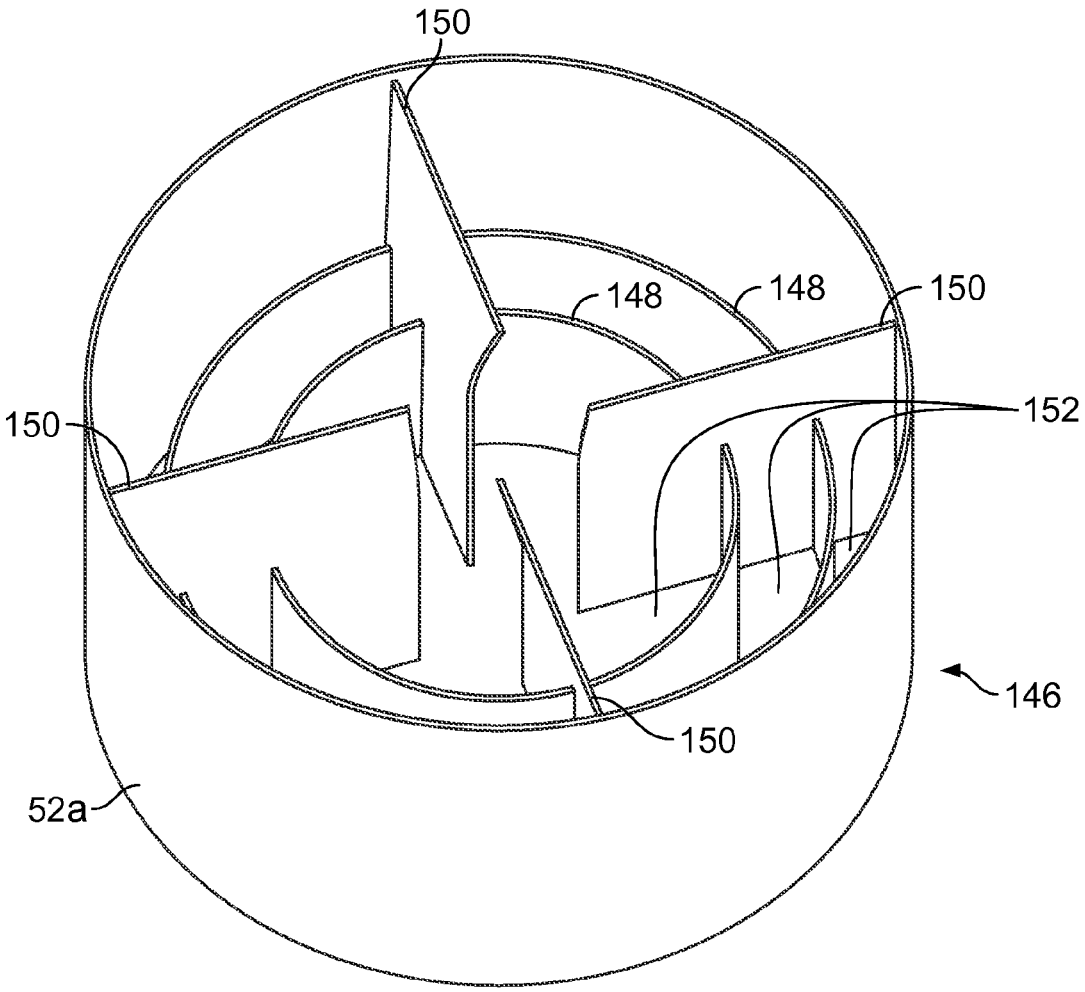
FIG. 13 illustrates a perspective view of the inlet side of a swirl reducer according to an embodiment of the present invention.
Figure 14:
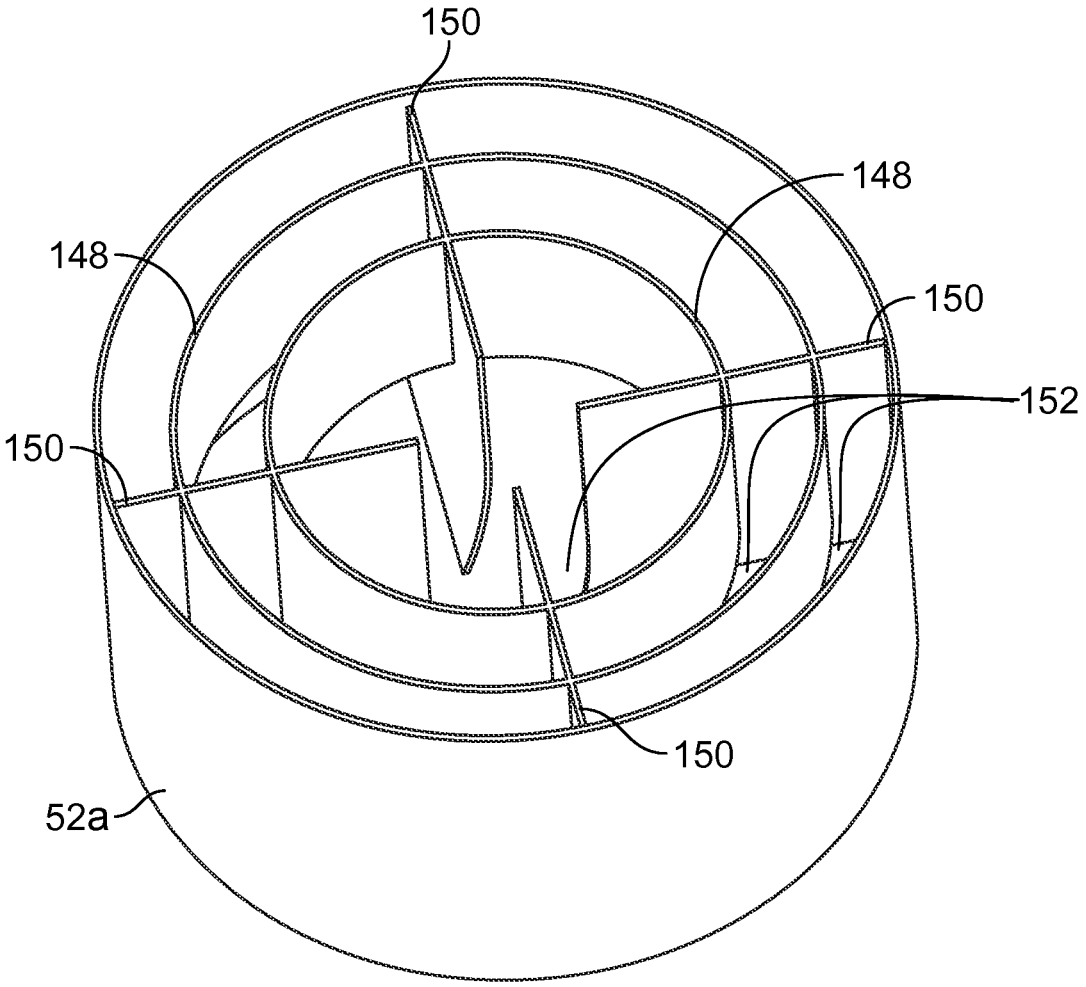
FIG. 14 illustrates a perspective view of the discharge side of a swirl reducer according to an embodiment of the present invention.

To condition the fluid flow distribution delivered to the non-final stage compressor 26 from the non-final stage suction inlet pipe 50, a swirl reducer or deswirler 146, as illustrated in FIGS. 13 and 14 and described further below, can be optionally incorporated into the non-final stage suction inlet pipe 50. The refrigerant gas passes through the non-final stage suction inlet pipe 50 as it is drawn by the multi-stage centrifugal compressor 24, and specifically the non-final stage centrifugal compressor 26.

Generally, a multi-stage compressor compresses refrigerant gas or other vaporized fluid in stages by the rotation of one or more impellers during operation of the chiller's closed refrigeration circuit. This rotation accelerates the fluid and in turn, increases the kinetic energy of the fluid. Thereby, the compressor raises the pressure of fluid, such as refrigerant, from an evaporating pressure to a condensing pressure. This arrangement provides an active means of absorbing heat from a lower temperature environment and rejecting that heat to a higher temperature environment.

Figure 4:
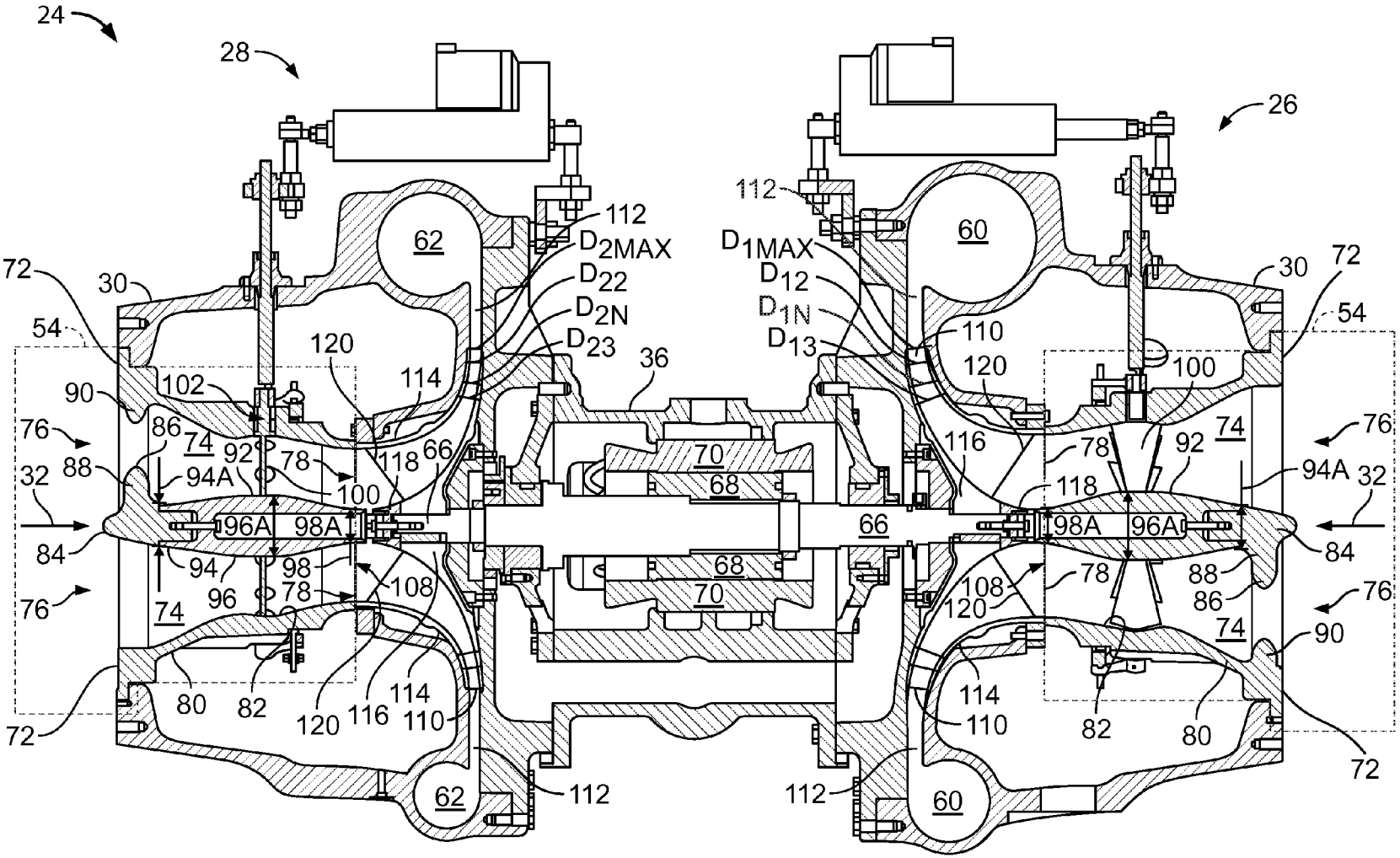
FIG. 4 illustrates a cross-sectional view of a multi-stage centrifugal compressor for a chiller system according to an embodiment of the present invention.

Referring now to FIG. 4, the compressor 24 is typically an electric motor driven unit. A variable speed drive system drives the multi-stage compressor. The variable speed drive system comprises a permanent magnet motor 36 located preferably in between the non-final stage compressor 26 and the final stage compressor 28 and a variable speed drive 38 having power electronics for low voltage (less than about 600 volts), 50 Hz and 60 Hz applications. The variable speed drive system efficiency, line input to motor shaft output, preferably can achieve a minimum of about 95 percent over the system operating range.

While conventional types of motors can be used with and benefit from embodiments of the present invention, a preferred motor is a permanent magnet motor 36. Permanent magnet motor 36 can increase system efficiencies over other motor types.

A preferred motor 36 comprises a direct drive, variable speed, hermetic, permanent magnet motor. The speed of the motor 36 can be controlled by varying the frequency of the electric power that is supplied to the motor 36. The horsepower of preferred motor 36 can vary in the range of about 125 to about 2500 horsepower.

The permanent magnet motor 36 is under the control of a variable speed drive 38. The permanent magnet motor 38 of a preferred embodiment is compact, efficient, reliable, and relatively quieter than conventional motors. As the physical size of the compressor assembly is reduced, the compressor motor used must be scaled in size to fully realize the benefits of improved fluid flow paths and compressor element shape and size. A preferred motor 36 is reduced in volume by approximately 30 to 50 percent or more when compared to conventional existing designs for compressor assemblies that employ induction motors and have refrigeration capacities in excess of 250-tons. The resulting size reduction of embodiments of the present invention provides a greater opportunity for efficiency, reliability, and quiet operation through use of less material and smaller dimensions than can be achieved through more conventional practices.

Typically, an AC power source (not shown) will supply multiphase voltage and frequency to the variable speed drive 38. The AC voltage or line voltage delivered to the variable speed drive 38 will typically have nominal values of 200V, 230V, 380V, 415V, 480V, or 600V at a line frequency of 50 Hz or 60 Hz depending on the AC power source.

The permanent magnet motor 36 comprises a rotor 68 and a stator 70. The stator 70 consists of wire coils formed around laminated steel poles, which convert variable speed drive applied currents into a rotating magnetic field. The stator 70 is mounted in a fixed position in the compressor assembly and surrounds the rotor 68, enveloping the rotor with the rotating magnetic field. The rotor 68 is the rotating component of the motor 36 and consists of a steel structure with permanent magnets, which provide a magnetic field that interacts with the rotating stator magnetic field to produce rotor torque. The rotor 68 may have a plurality of magnets and may comprise magnets buried within the rotor steel structure or be mounted at the rotor steel structure surface. The rotor 68 surface mount magnets are secured with a low loss filament, metal retaining sleeve or by other means to the rotor steel support. The performance and size of the permanent magnet motor 36 is due in part to the use of high energy density permanent magnets.

Permanent magnets produced using high energy density magnetic materials, at least 20 MGOe (Mega Gauss Oersted), produce a strong, more intense magnetic field than conventional materials. With a rotor that has a stronger magnetic field, greater torques can be produced, and the resulting motor can produce a greater horsepower output per unit volume than a conventional motor, including induction motors. By way of comparison, the torque per unit volume of permanent magnet motor 36 is at least about 75 percent higher than the torque per unit volume of induction motors used in refrigeration chillers of comparable refrigeration capacity. The result is a smaller sized motor to meet the required horsepower for a specific compressor assembly.

Further manufacturing, performance, and operating advantages and disadvantages can be realized with the number and placement of permanent magnets in the rotor 68. For example, surface mounted magnets can be used to realize greater motor efficiencies due to the absence of magnetic losses in intervening material, ease of manufacture in the creation of precise magnetic fields, and effective use of rotor fields to produce responsive rotor torque. Likewise, buried magnets can be used to realize a simpler manufactured assembly and to control the starting and operating rotor torque reactions to load variations.

The bearings, such as rolling element bearings (REB) or hydrodynamic journal bearings, can be oil lubricated. Other types of bearings can be oil-free systems. A special class of bearing which is refrigerant lubricated is a foil bearing and another uses REB with ceramic balls. Each bearing type has advantages and disadvantages that should be apparent to those of skill in the art. Any bearing type that is suitable of sustaining rotational speeds in the range of about 2,000 to about 20,000 RPM may be employed.

The rotor 68 and stator 70 end turn losses for the permanent magnet motor 36 are very low compared to some conventional motors, including induction motors. The motor 36 therefore may be cooled by means of the system refrigerant. With liquid refrigerant only needing to contact the stator 70 outside diameter, the motor cooling feed ring, typically used in induction motor stators, can be eliminated. Alternatively, refrigerant may be metered to the outside surface of the stator 70 and to the end turns of the stator 70 to provide cooling.

The variable speed drive 38 typically will comprise an electrical power converter comprising a line rectifier and line electrical current harmonic reducer, power circuits and control circuits (such circuits further comprising all communication and control logic, including electronic power switching circuits). The variable speed drive 38 will respond, for example, to signals received from a microprocessor (also not shown) associated with the chiller control panel 182 to increase or decrease the speed of the motor by changing the frequency of the current supplied to motor 36. Cooling of motor 36 and/or the variable speed drive 38, or portions thereof, may be by using a refrigerant circulated within the chiller system 20 or by other conventional cooling means. Utilizing motor 36 and variable speed drive 38, the non-final stage compressor 26 and a final stage compressor 28 typically have efficient capacities in the range of about 250-tons to about 2,000-tons or more, with a full load speed range from approximately 2,000 to above about 20,000 RPM.

With continued reference to FIG. 4 and turning to the compressor structure, the structure and function of the non-final stage compressor 26, final stage compressor 28 and any intermediate stage compressor (not shown) are substantially the same, if not identical, and therefore are designated similarly as illustrated in the FIG. 4, for example. Differences, however, between the compressor stages exist in a preferred embodiment and will be discussed below. Features and differences not discussed should be readily apparent to one of ordinary skill in the art.

Preferred non-final stage compressor 26 has a compressor housing 30 having both a compressor inlet 32 and a compressor outlet 34. The non-final stage compressor 26 further comprises an inlet flow conditioning assembly 54, a non-final stage impeller 56, a diffuser 112 and a non-final stage external volute 60.

The non-final stage compressor 26 can have one or more rotatable impellers 56 for compressing a fluid, such as refrigerant. Such refrigerant can be in liquid, gas or multiple phases and may include R-123 refrigerant. Other refrigerants, such as R-134a, R-245fa, R-141b and others, and refrigerant mixtures are contemplated. Further, the present invention contemplates use of azeotropes, zeotropes and/or a mixture or blend thereof that have been and are being developed as alternatives to commonly used contemplated refrigerants. One advantage that should be apparent to one of ordinary skill in the art is that, in the case of a medium pressure refrigerant, the gear box typically used in high speed compressors can be eliminated.

By the use of motor 36 and variable speed drive 38, multistage compressor 24 can be operated at lower speeds when the flow or head requirements on the chiller system do not require the operation of the compressor at maximum capacity, and operated at higher speeds when there is an increased demand for chiller capacity. That is, the speed of motor 36 can be varied to match changing system requirements which results in approximately 30 percent more efficient system operation compared to a compressor without a variable speed drive. By running compressor 24 at lower speeds when the load or head on the chiller is not high or at its maximum, sufficient refrigeration effect can be provided to cool the reduced heat load in a manner which saves energy, making the chiller more economical from a cost-to-run standpoint and making chiller operation extremely efficient as compared to chillers which are incapable of such load matching.

Referring still to FIGS. 1-4, refrigerant is drawn from the non-final stage suction piping 50 to an integrated inlet flow conditioning assembly 54 of the non-final stage compressor 26. The integrated inlet flow conditioning assembly 54 comprises an inlet flow conditioning housing 72 that forms a flow conditioning channel 74 with flow conditioning channel inlet 76 and flow conditioning channel outlet 78. The channel 74 is defined, in part, by a shroud wall 80 having an inside shroud side surface 82, a flow conditioning nose 84, a strut 86, a flow conditioning body 92 and a plurality of inlet guide blades/vanes 100. These structures, which may be complimented with swirl reducer 146, cooperate to produce fluid flow characteristics that are delivered into the vanes 100, such that less turning of the vanes 100 is required to create the target swirl distribution for efficient operation in impellers 56, 58.

The flow conditioning channel 74 is a fluid flow path extending from a flow conditioning channel inlet 76, adjacent to the discharge end of the non-final stage suction pipe 50, and a flow conditioning channel outlet 78. The flow conditioning channel 74 extends through the axial length of the inlet flow conditioning assembly 54. Preferably, the flow conditioning channel 74 generally has a smooth, streamlined cross-section that tapers radially along the length of the inlet flow conditioning housing 72 and has portion of the shroud side surface 82 shaped such that a preferred shroud side edge 104 of the vanes 100 can nest therein. The channel inlet 76 of the flow conditioning channel 74 may have a diameter to approximately match the inner diameter of the non-final stage suction pipe 50. The sizing of the channel inlet 76 preferably has at least a channel inlet area to impeller inlet plane area ratio greater than 2.25. The diameter of the channel inlet 76 may vary based on the design boundary conditions for a given application.

The flow conditioning nose 84 preferably is centrally positioned along the axis of rotation of each of the impellers 56, 58 in the inlet flow conditioning assembly 54. The flow conditioning nose 84 has preferably a conical shape. The flow conditioning nose 84 is preferably formed by a cubic spline whose endpoint slope is the same as the non-final stage suction pipe 50. The size and shape of the flow conditioning nose 84 may vary. For example, the nose 84 can take the shape of a bi-conic, tangent ogive, secant ogive, elliptical parabolic or power series.

Figure 5:
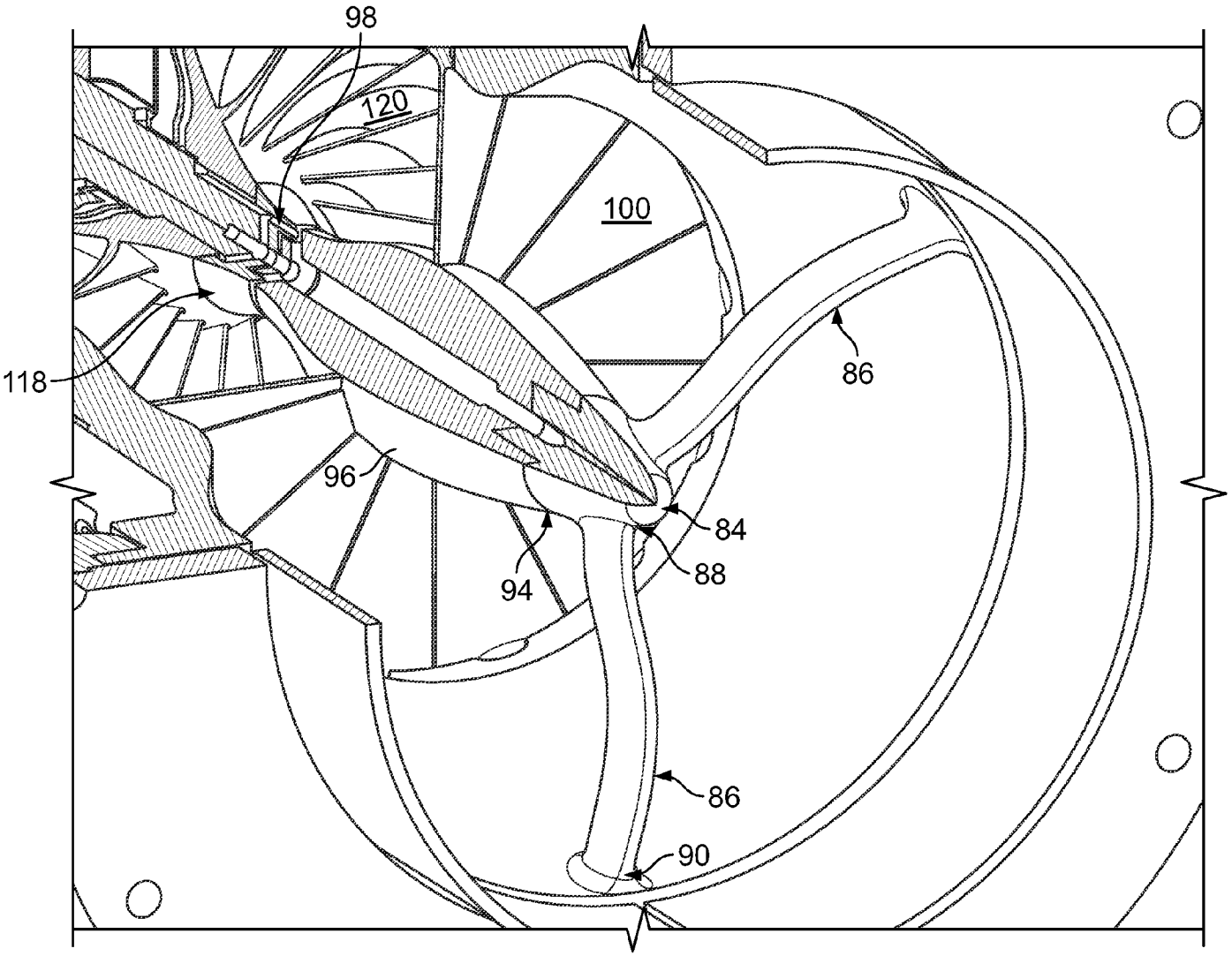
FIG. 5 illustrates a perspective view of an inlet flow conditioning assembly, shown with the inlet guide vanes in a fully closed position, according to an embodiment of the present invention.

Referring now to FIG. 5, the flow conditioning nose 84 is optionally connected, preferably integrally, to a strut 86 at or adjacent to the channel inlet 76. The strut 86 positions the flow conditioning nose 84 in the flow conditioning channel 74 and has a first strut end 88 preferably attached to the flow conditioning nose 84 and a second strut end 90 preferably attached to the shroud wall 80. The strut 86 also distributes a fluid flow wake across a plurality of inlet guide vanes/blades 100. The strut 86 can take various shapes and may comprise more than one strut 86. Preferably, the strut 86 has an "S"-like shape in a plane substantially parallel to the channel inlet 76, as depicted in FIG. 5, and the strut 86 has a mean camber line aligned in a flow direction plane of the channel inlet 76, and preferably has a symmetric thickness distribution around the mean camber line of the strut 86 in the flow direction plane (channel inlet 76 to channel outlet 78) of the channel inlet 76. The strut 86 can be cambered and preferably, has a thin symmetrical airfoil shape in a flow direction plane of the channel inlet 76. The shape of the strut 86 is such that it minimizes blockage, and at the same time accommodates casting and mechanical demands. If the flow conditioning nose 84 and the inlet flow conditioning housing 72 are to be cast as one integral unit, the strut 86 aids in the process of casting together the flow conditioning nose 84 and the inlet flow conditioning housing 72.

Connected, e.g. integrally or mechanically, to the flow conditioning nose 84 and strut 86 is a flow conditioning body 92. The flow conditioning body 92 is an elongate structure that preferably extends the length of the flow conditioning channel 74 from channel inlet 76 to or coincident with an impeller hub nose 118.

The flow conditioning body 92 has a first body end 94, an intermediate portion 96, and a second body end 98, which forms a shape that increases the mean radius of the inlet guide vanes 100 relative to the entrance of the impellers 56, 58. This results in less turning of the vanes 100 to achieve the target tangential velocity of the fluid flow than if no flow conditioning body 92 were present. In one embodiment, the first body end 94, intermediate portion 96 and second body end 98 each have a radius 94A, 96A and 98A, respectively, extending from an axis of rotation of the impellers 56, 58. The radius 96A of the intermediate portion 96 is larger than either the first body end radius 94A or second body end radius 98A. In a preferred embodiment, the flow conditioning body 92 has a curved exterior surface of varying height along the axis of rotation of the impellers, where the ratio of the maximum radius curvature of the flow conditioning body 92 to the radius of the inlet plane of the impeller hub 116 is about 2:1.

Figure 6:
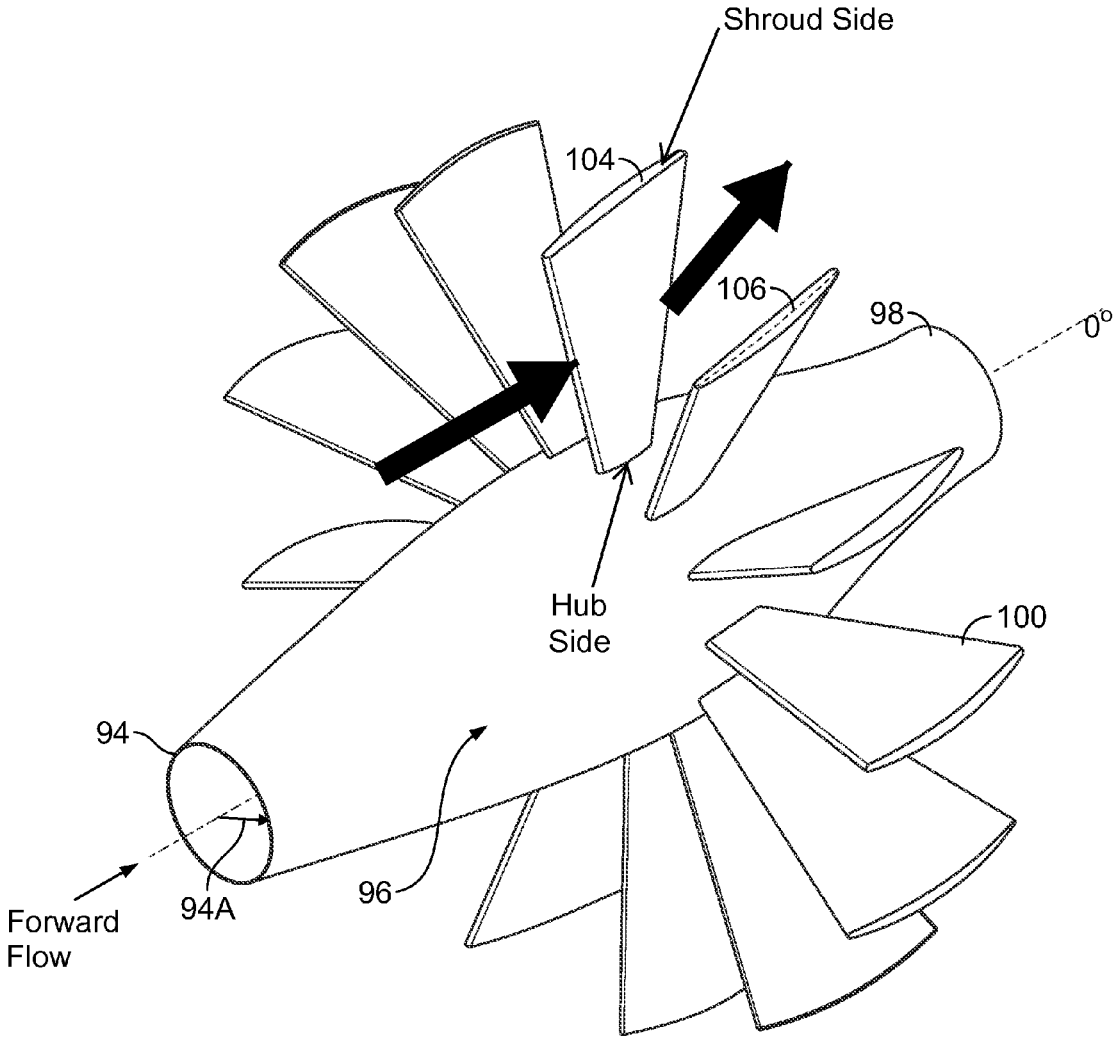
FIG. 6 illustrates a perspective view of an arrangement of a plurality of inlet guide vanes mounted on a flow conditioning body, shown with the inlet guide vanes in a fully open position, for an exemplary non-final stage compressor according to an embodiment of the present invention.

Referring to FIGS. 4-6, the plurality of inlet guide vanes 100 are preferably positioned between the channel inlet 76 and channel outlet 78 at the location where the largest radius of the flow conditioning body 92. FIG. 6 shows an embodiment of the inlet guide vanes 100 with the inlet flow conditioning housing 72 removed. The plurality of inlet guide vanes 100 have a variable spanwise camber distribution from hub to shroud. The inlet guide vanes 100 also preferably are radial varying cambered airfoils with symmetrical thickness distribution to embed the supporting shaft 102.

The inlet flow conditioning housing 72 is preferably shaped to allow the shroud side edge 104 of the inlet guide vanes 100 to rotatably nest in the inlet flow conditioning housing 72. A preferred shape for the inside wall surface 82 and shroud side edge 104 is substantially spherical. Other shapes for the inside wall surface 82 and shroud side edge 104 should be apparent. Nesting of the plurality of inlet guide vanes 100 into a spherical cross section formed on wall 82 maximizes blade guidance and minimizes leakage for any position of the inlet guide vanes 100 through a full range of rotation. The plurality of vanes 100 on the hub side preferably conform to the shape of the flow conditioning body 92 at location at which the vanes 100 are positioned in the inlet flow condition channel 74. The plurality of vanes may additionally be shaped to nest into the flow conditioning body 92.

As seen in FIGS. 4-6, the plurality of inlet guide vanes 100 are sized and shaped to be fully closed to minimize gaps between the leading edge and trailing edge of adjacent inlet guide vanes 100 and gaps at the wall surface 82, shroud side. The chord length 106 of the inlet guide vanes 100 is chosen, at least in part, to further provide leakage control. Some overlap between the leading edge and trailing edge of the plurality of inlet guide vanes 100 is preferred. It should be apparent that because the hub, mid, and shroud radii of the plurality of inlet guide vanes 100 are greater than the downstream hub, mid, and shroud radii of the plurality of impeller blades 120 that less camber of the plurality of inlet guide vanes 100 is required to achieve the same target radial swirl.

Specifically, the guide vanes 100 are sized and shaped to impart a constant radial swirl, in the range of about 0 to about 20 degrees, at or upstream of the impeller inlet 108 with minimum total pressure loss of the compressor through the guide vanes 100. In a preferred embodiment, the variable spanwise camber produces about a constant radial 12 degrees of swirl at the impeller inlet 108. The inlet guide vanes 100 as a result do not have to be closed as much, which produces less pressure drop through inlet guide vanes 100. This allows the inlet guide vanes 100 to stay in their minimum loss position, and yet provide the target swirl.

The plurality of vanes 100 can be positioned in a fully open position with the leading edge of the plurality of blades 120 aligned with the flow direction and the trailing edge of the blades 120 having radially varying camber from the hub side to the shroud side. This arrangement of the plurality of blades 120 is such that the plurality of inlet guide vanes 100 also can impart 0 to about 20 degrees of swirl upstream of the impeller inlet 108 with minimum total pressure loss of the compressor after the fluid passes through the guide vanes 100. Other configurations for the vanes 100, including omitting them from certain stages for a given application, should be readily known to a person of ordinary skill in the art.

Advantages of delivering the fluid through the integrated inlet flow conditioning assembly 54 should be readily apparent from at least the following. The inlet flow conditioning assembly 54 controls the swirl distribution of refrigerant gas delivered into the impellers 56, 58 so that the required inlet velocity triangles can be produced with minimized radial and circumferential distortion. Distortion and control of flow distribution is achieved, for example, by creating a constant angle swirl distribution going into the impeller inlet 108. This flow results in lower losses, yet achieves levels of control over kinematic and thermodynamic flow field distribution. Any other controlled swirl distribution that provides suitable performance can be acceptable as long as it is integrated in the design of the impellers 56, 58. The swirl caused along the flow conditioning channel 74 allows refrigerant vapor to enter the impellers 56, 58 more efficiently across a wide range of compressor capacities.

Turning now to the impellers, the drawing of FIG. 4 also depicts a double-ended shaft 66 that has a non-final stage impeller 56 mounted on one end of the shaft 66 and a final stage impeller 58 on the other end of the shaft 66. The double-ended shaft configuration of this embodiment allows for two or more stages of compression. The impeller shaft 66 is typically dynamically balanced for vibration reduced operation, preferably and predominantly vibration free operation.

Different arrangements and locations of the impellers 56, 58; shaft 66 and motor 36 should be apparent to one of ordinary skill in the art as being within the scope of the invention. It should be also understood that in this embodiment the structure and function of the impeller 56, impeller 58 and any other impellers added to the compressor 24 are substantially the same, if not identical. However, impeller 56, impeller 58 and any other impellers may have to provide different flow characteristics impeller to impeller. For example, differences are apparent between a preferred non-final stage impeller 56 illustrated in FIG. 7A and a preferred final stage impeller 58 in FIG. 7B.

The impellers 56, 58 can be fully shrouded and made of high strength aluminum alloy. Impellers 56, 58 have an impeller inlet 108 and an impeller outlet 110 where the fluid exits into a diffuser 112. The typical components of impellers 56, 58 comprise an impeller shroud 114, an impeller hub 116 having an impeller hub nose 118, and a plurality of impeller blades 120. Sizing and shaping of the impellers 56, 58 is dependent, in part, on the target speed of the motor 36 and the flow conditioning accumulated upstream of the impellers, if any, from use of the inlet flow conditioning assembly 54 and the optional swirl reducer 146.

In prior systems, the first stage compressor and its components (e.g. the impeller) have been typically sized by optimizing the first stage operation and allowing later stages to operate at, and in turn, be sized for, non-optimal operation. In embodiments of the present invention, in contrast, the target speed of variable speed motor 36 is preferably selected by setting the target speed at each tonnage capacity to optimize the final stage compressor 28 to operate within an optimal specific speed range for targeted combinations of capacity and head. One expression of specific speed is: $N_S$=RPM*sqrt (CFM/60))/$\Delta H_{is}^{3/4}$, where the RPM is the revolutions per minute, CFM is the volume of fluid flow in cubic feet per minute and the $\Delta H_{is}$ is the change in isentropic head rise in BTU/lb.

In a preferred embodiment, the final stage compressor 28 is designed for a near optimum specific speed ($N_S$) range (e.g., 95-130), where the non-final stage compressor 26 may float such that its specific speed may be higher than the optimal specific speed of the final stage compressor 28, e.g. $N_S$=95-180. Using the selected target motor speed such the final stage compressor 28 operates at optimum specific speed allows the diameter of the impellers 56, 58 to be determined conventionally to meet head and flow requirements. By sizing the non-final stage compressor 26 to operate above the optimum specific speed range of the final stage compressor 28, the rate of change of efficiency loss is less than if the compressor operated at optimum specific speed or less, which can be confirmed by the relation of compressor adiabatic efficiency of the non-final stage 26 with specific speed.

As the specific speed ranges from higher values (e.g. above about 180) to near optimum (e.g., 95-130), the exit pitch angles of impellers 56, 58 each vary, when measured from the axis of rotation of the impellers 56, 58. The exit pitch angles can vary from about 20 degrees to 90 degrees (a radial impeller), with about 60 degrees to 90 degrees being a preferred exit pitch angle range.

The impellers 56, 58 are preferably each cast as a mixed flow impeller to a maximum diameter for a predetermined compressor nominal capacity. For a given application capacity within the operating speed range of motor 36, the impellers 56, 58 are shaped from a maximum diameter (e.g., $D_{1max}$, $D_{2max}$, $D_{imax}$, etc.) via machining or other means such that fluid flow exiting the impellers 56, 58 would be in a radial or mixed flow regime during operation for the given head and flow requirements. The impellers 56, 58 sized for the given application may have equal or unequal diameters for each stage of compression. The impellers 56, 58 alternatively could be cast to the application sizes without machining the impellers to the application diameters.

A single casting with a maximum diameter for impellers 56, 58 can thus be used for numerous flow requirements within a wide operating range for a given compressor capacity by varying speed and impeller diameter size. By way of specific example, a representative example is a 38.1/100.0 cycle, 300-ton nominal capacity compressor 24 for 62 degrees of lift would have a target speed of about 6150 RPM. The final stage compressor 28 is sized to operate within the optimum specific speed range for these loading requirements and non-final stage compressor 26 is sized to operate with a specific speed that exceeds the optimum specific speed range for the final stage compressor 28.

Figure 8A:
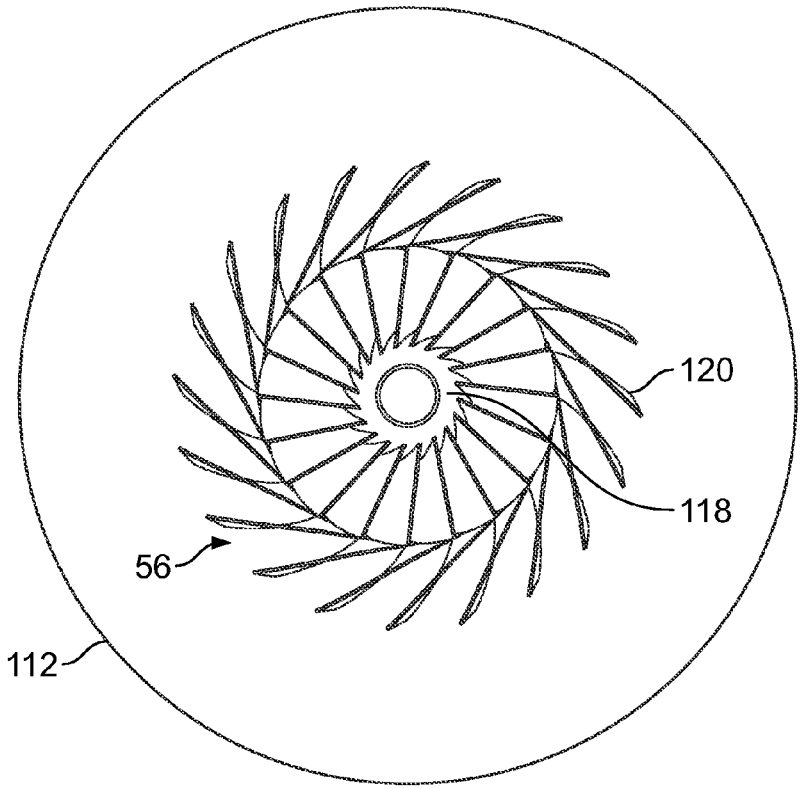
FIG. 8A illustrates a view of a mixed flow impeller and diffuser with the shroud removed sized for a 300-ton, non-final stage compressor of a chiller system according to an embodiment of the present invention.
Figure 8B:
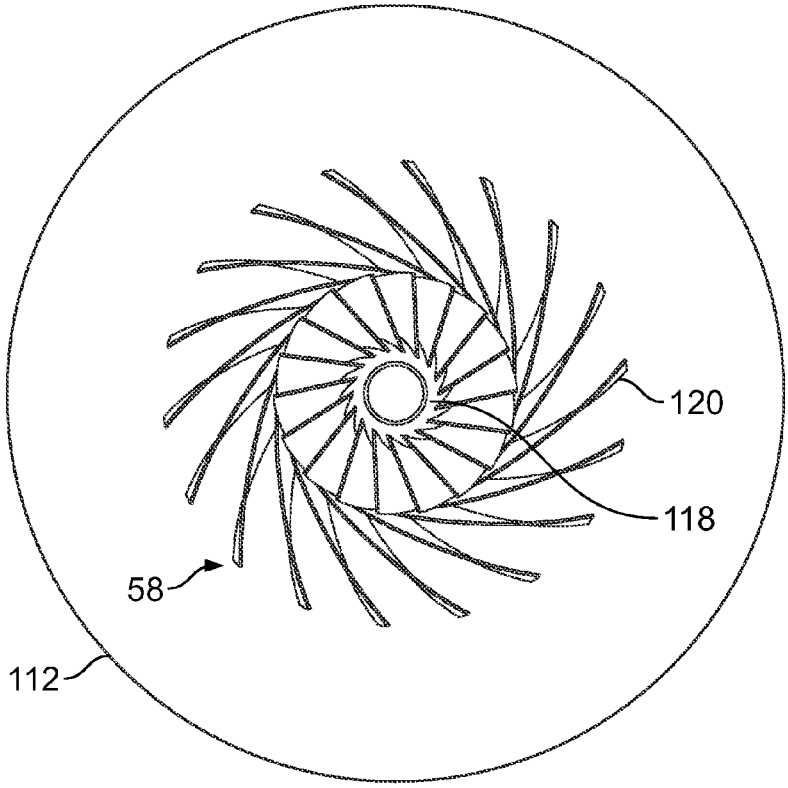
FIG. 8B illustrates a view of a mixed flow impeller and diffuser with the shroud removed sized for a 300-ton, final stage compressor of a chiller system according to an embodiment of the present invention.

Specifically, for such a 300-ton capacity compressor, the final stage mixed flow impeller 58 is cast to a maximum diameter at $D_{2max}$ and machined to $D_{2N}$ for a 300-ton final stage impeller diameter as illustrated in FIGS. 4 and 8B. The resulting final stage exit pitch angle is about 90 degrees (or a radial exit pitch angle). The 300-ton, non-final stage mixed flow impeller 56, in turn, is cast to a maximum diameter at $D_{1max}$ and machined to $D_{1N}$ for the 300-ton, non-final stage impeller diameter, as illustrated in FIGS. 4 and 8A. The non-final stage exit pitch angle will be less than the exit pitch angle of the final stage impeller 58 (i.e. mixed flow, having both radial and axial flow components), because the non-final stage specific speed is higher than the optimum specific speed range for the final stage compressor 28.

This approach also enables this 300-ton compressor to be sized to operate over a broad range of capacity increments. For example, the illustrative 300-ton capacity compressor can operate efficiently between 250-ton and 350-ton capacity.

Figure 9A:
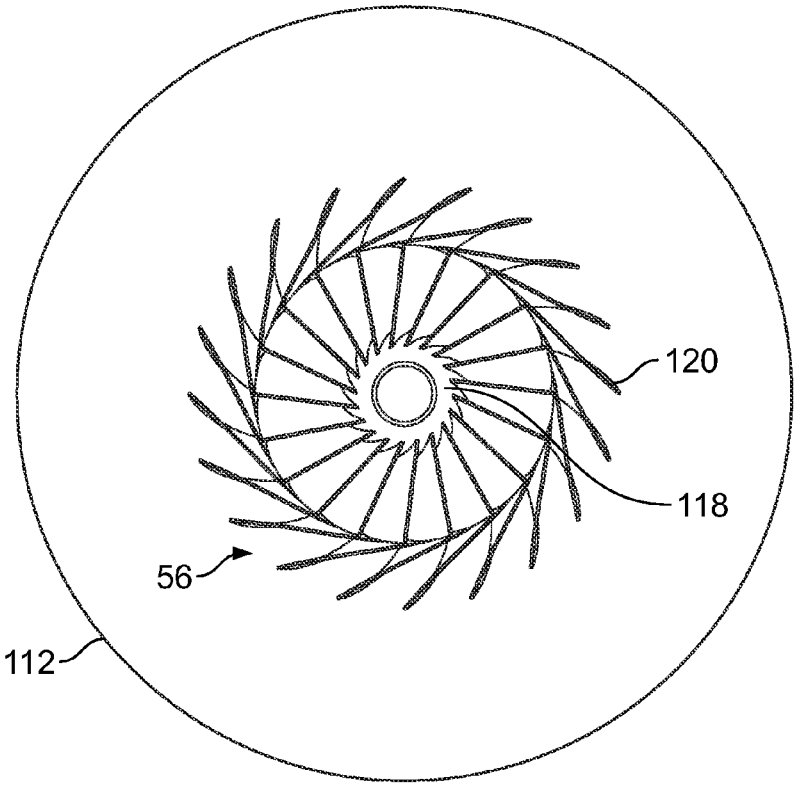
FIG. 9A illustrates a view of a mixed flow impeller and diffuser with the shroud removed sized for a 350-ton, non-final stage compressor of a chiller system according to an embodiment of the present invention.
Figure 9B:
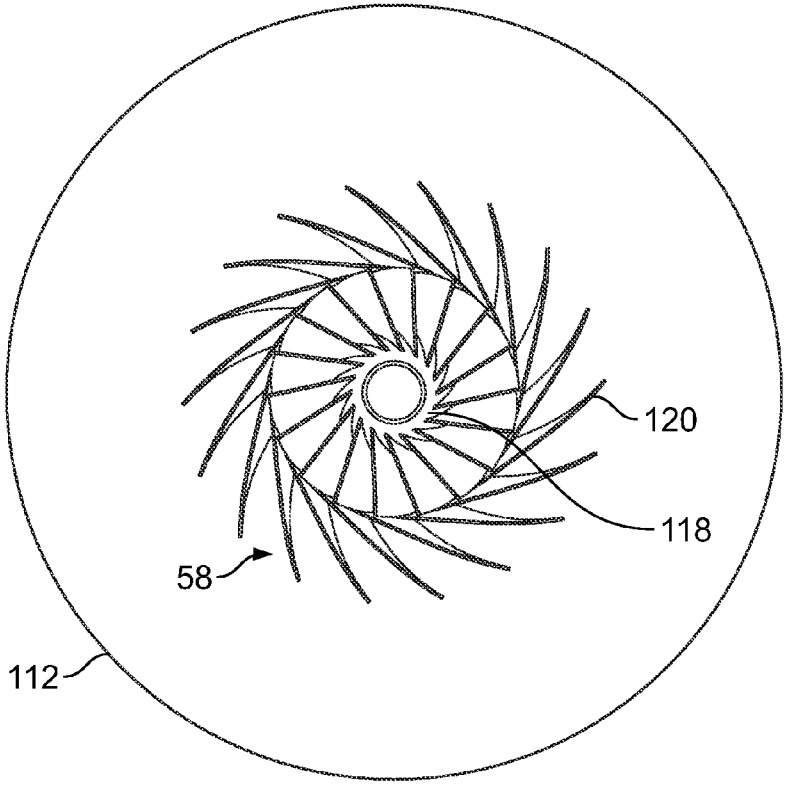
FIG. 9B illustrates a view of a mixed flow impeller and diffuser with the shroud removed sized for a 350-ton, final stage compressor of a chiller system according to an embodiment of the present invention.

Specifically, when the illustrative 300-ton capacity compressor is to deliver application head and flow rate for a 350-ton capacity, the same motor 36 will operate at a higher speed (e.g. about 7175 RPM) than 300-ton nominal speed (e.g. about 6150 RPM). The final stage impeller 58 will be cast to the same maximum diameter as the 300-ton impeller at $D_{2max}$, and machined to $D_{23}$ for the 350-ton, final stage impeller diameter, as illustrated in FIGS. 4 and 9B. The 350-ton diameter set at $D_{23}$ is decreased from the 300-ton impeller diameter, set at $D_{2N}$. The 350-ton, final stage exit pitch angle, in turn, results in a mixed flow exit. The 300-ton, non-final stage mixed flow impeller 56, in turn, is cast to the same maximum diameter as the 300-ton impeller at $D_{1max}$ and machined to $D_{13}$ for the 350-ton, non-final stage impeller diameter, as illustrated in FIG. 4 and FIG. 9A. The 350-ton, non-final stage exit pitch angle will be about equal to the 350-ton, final stage exit pitch angle (i.e., both mixed flow), because the non-final stage specific speed remains higher than the optimum specific speed range for the final stage compressor 28.

Figure 7A:
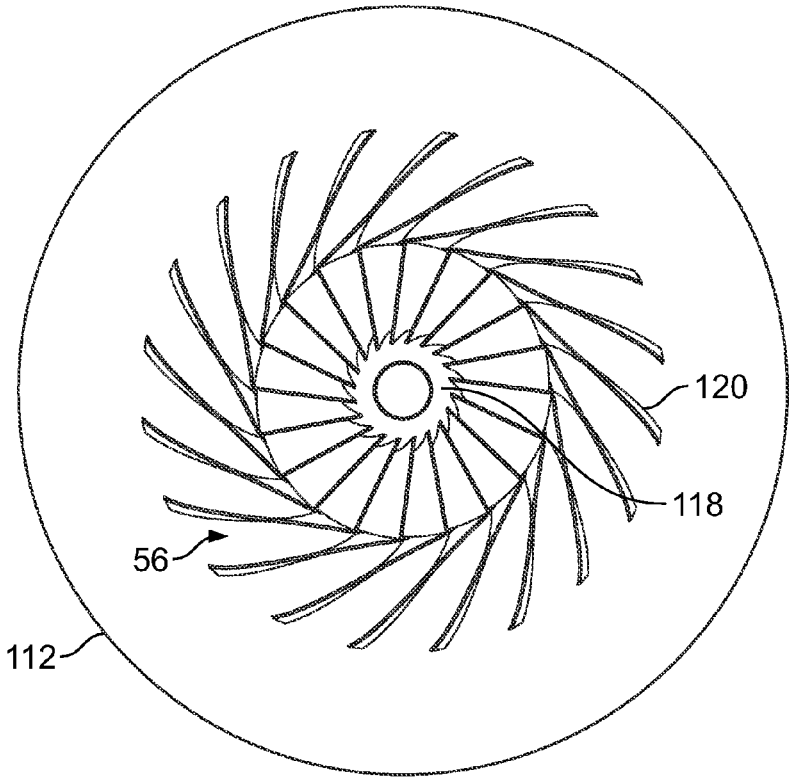
FIG. 7A illustrates a view of a mixed flow impeller and diffuser with the shroud removed sized for a 250-ton, non-final stage compressor of a chiller system according to an embodiment of the present invention.
Figure 7B:
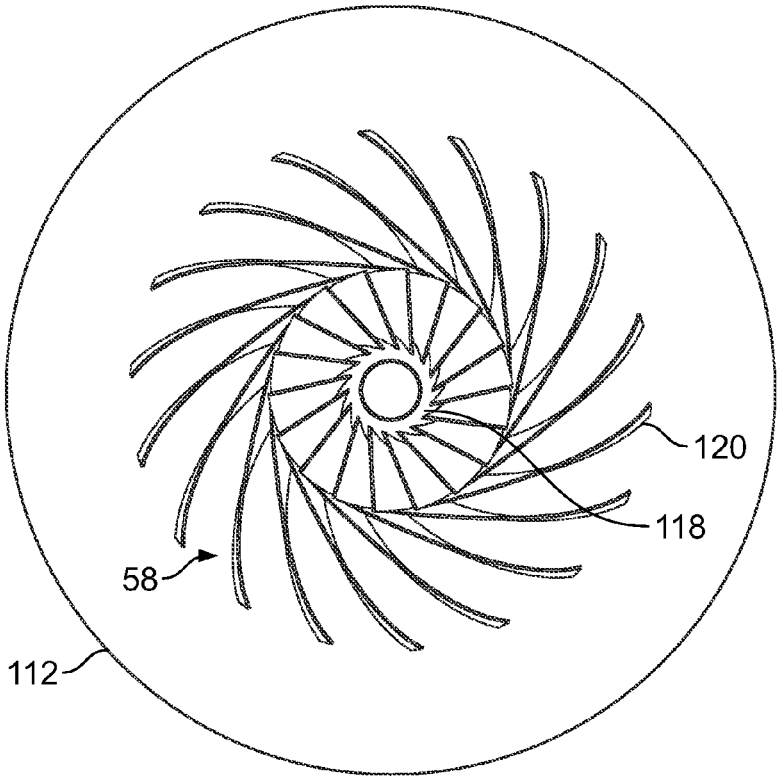
FIG. 7B illustrates a view of a mixed flow impeller and diffuser with the shroud removed sized for a 250-ton, final stage compressor of a chiller system according to an embodiment of the present invention.

Similarly, when the illustrative 300-ton capacity compressor is to deliver application head and flow rate for a 250-ton capacity, the same motor will also operate at a lower speed (e.g. about 5125 RPM) than 300-ton nominal speed (e.g. 6150 RPM). The final stage impeller 58 will be cast to the same maximum diameter as the 300-ton impeller at $D_{2max}$ and machined to $D_{22}$ for the 250-ton, final stage impeller diameter, as illustrated in FIGS. 4 and 7B. The 250-ton diameter set at $D_{22}$ is increased from the 300-ton impeller diameter set at $D_{2N}$. The 250-ton, final stage exit pitch angle is about 90 degrees (or a radial exit pitch angle). The 250-ton, non-final stage mixed flow impeller, in turn, is cast to the same maximum diameter as the 300-ton impeller at $D_{1max}$ and machined to $D_{12}$ for the 250-ton, non-final stage impeller diameter, as illustrated in FIG. 4 and FIG. 7A. The 250-ton, non-final stage exit pitch angle will be about equal to the 250-ton, final stage exit pitch angle (i.e., both radial flow), because the non-final stage specific speed remains lower than the optimum specific speed range for the final stage compressor 28. For any compressor sized in this way, for example, the exemplary impeller diameters discussed above could vary about at least ±3 percent to achieve a possible range of head application from standard ARI to conditions in other locations, like the Middle East.

Integral to sizing impellers 56, 58 as discussed is to follow the impellers 56, 58 by vaneless diffusers 112, which may be a radial or a mixed flow diffuser. The diffusers 112 for each stage have inlets and outlets. Vaneless diffusers 112 provide a stable fluid flow field and are preferred, but other conventional diffuser arrangements are acceptable if suitable performance can be achieved.

The diffuser 112 has a diffuser wall profile coincident with the meridional profile of the impellers 56, 58 with maximum diameter (e.g. set at $D_{1max}$ or $D_{2max}$) for at least about 50 to 100 percent of the fluid flow path length. That is, the diffuser is machined so that it is substantially identical (within machining tolerances) to the meridional profile of the impeller with maximum diameter after the impellers have been machined to the application target head and flow rates.

In addition, the exit area through any two pluralities of impeller blades 120 is of constant cross-sectional area. When trimmed, a first diffuser stationary wall section of diffuser 112 forms a first constant cross-sectional area. A second diffuser stationary wall section of diffuser 112 forms a transition section where the local hub and shroud wall slopes are substantially matched to both the diffuser inlet and outlet. A third diffuser wall stationary wall section of diffuser 112 has constant width walls, rapidly increasing area toward the diffuser 112 outlet. Diffuser sizing can vary and depends upon target operation capacities of the chiller 20. The diffuser 112 has a slightly pinched diffuser area from the diffuser inlet to the diffuser outlet which aides in fluid flow stability.

As should be evident, embodiments of this invention advantageously produce efficiently performing compressors with a wide operating range of at least about 100-tons or more for a single size compressor. That is, a 300-ton nominal capacity compressor can efficiently run at a 250-ton capacity, 300-ton capacity, and a 350-ton capacity compressor (or at capacities in between) without changing the 300-ton nominal capacity structure (e.g. motor, housing, etc.) by selecting different speed and diameter combinations such that final stage compressor 28 is within an optimum specific speed range and the non-final stage compressor 28 floats above the optimum specific speed of the final stage.

The practical effect of employing embodiments of the present invention is that manufacturers of multistage compressors, particularly for refrigeration systems, need not offer twenty or more compressors optimized for each tonnage capacity, but may offer one compressor sized to operate efficiently over a wider range of tonnage capacities than previously known. Impellers 56, 58 lend themselves to inexpensive manufacturing, closer tolerances and uniformity. This results in significant cost savings to the manufacturers by reducing the number of parts to be manufactured and held in inventory.

Further aspects of the preferred impellers 56, 58 will now be discussed. The closed volume, formed by the impeller hub 116 and surfaces (bounded by the nose seal and exit tip leakage gap) of shroud 114, sets the rotating static pressure field which influences axial and radial thrust loads. The gaps between the stationary structures of the compressors 26, 28 and the moving parts of impellers 56, 58 are minimized to reduce the radial pressure gradient, which helps to control integrated thrust loads.

The impeller hub nose 118 is shaped to be coincident with the flow conditioning body 92 in the impeller inlet 108. Contouring the hub nose 118 with the flow conditioning body 92 further improves delivery of fluid through the impellers 56, 58 and can reduce flow losses through the impellers 56, 58.

As shown in FIG. 4, the plurality of impeller blades 120 are disposed between the impeller shroud 114 and impeller hub 116 and between impeller inlet 108 and impeller outlet 110. As shown in FIGS. 4, 7-11, any two adjacent of plurality of impeller blades 120 form a fluid path through which fluid is delivered with the rotation of the impellers 56, 58 from impeller inlet 108 to impeller outlet 110. Plurality of blades 120 are typically circumferentially spaced. The plurality of impeller blades 120 are of the full-inlet blade-type. Splitter blades can be used, but typically at increased design and manufacturing costs, particularly where the rotational Mach number is greater than 0.75.

A preferred embodiment of the plurality of blades, for example, in a 300-ton capacity machine, uses twenty blades for the non-final stage impeller 56, as shown in FIGS. 7A, 8A and 9A, and eighteen blades in the final stage impeller 58, as shown in FIGS. 7B, 8B and 9B. This arrangement can control blade blockage. Other blade counts are contemplated, including odd blade numbers.

Figure 10:
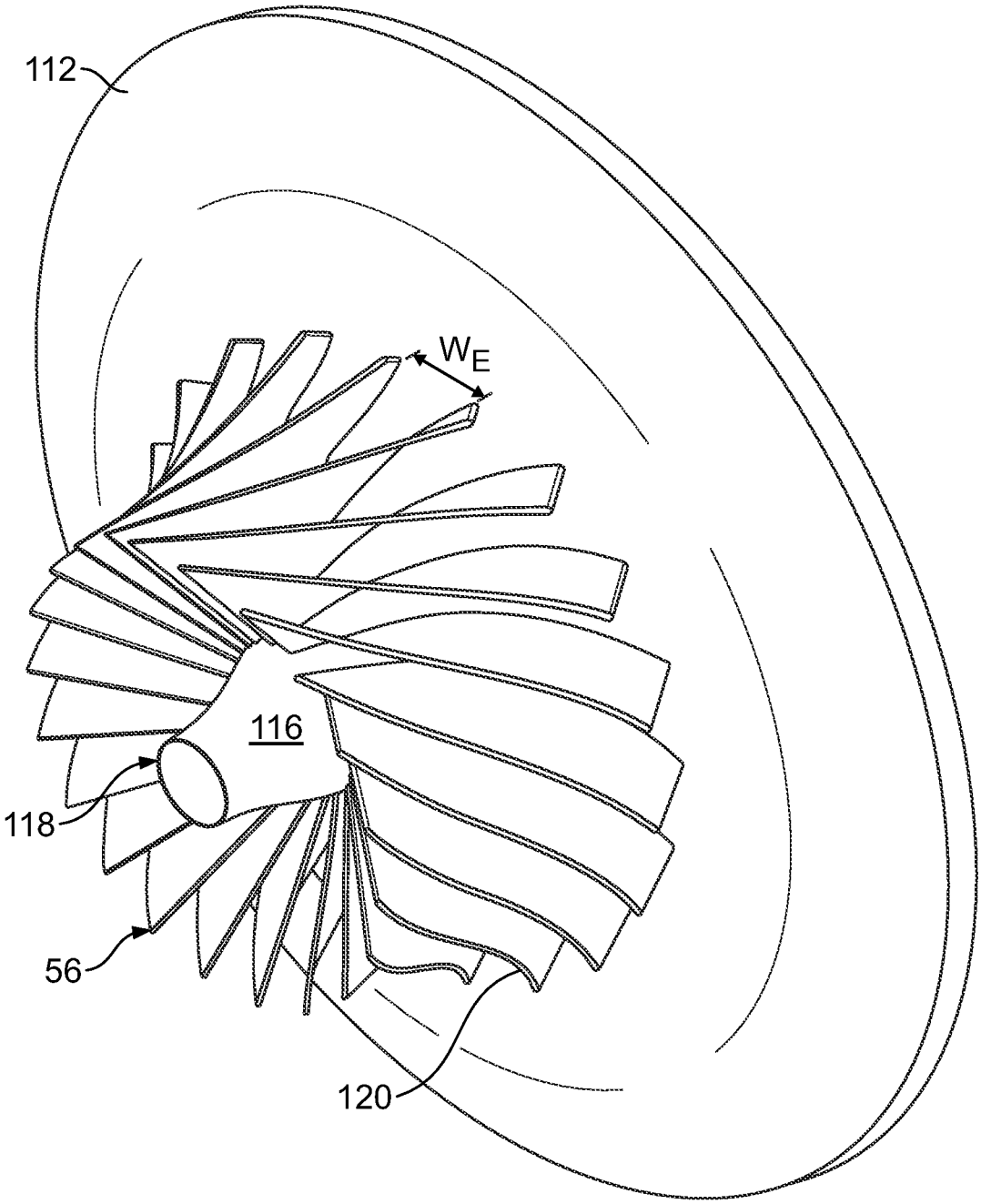
FIG. 10 illustrates a perspective view of a mixed flow impeller and diffuser with the shroud removed for a non-final stage compressor according to an embodiment of the present invention.
Figure 11:
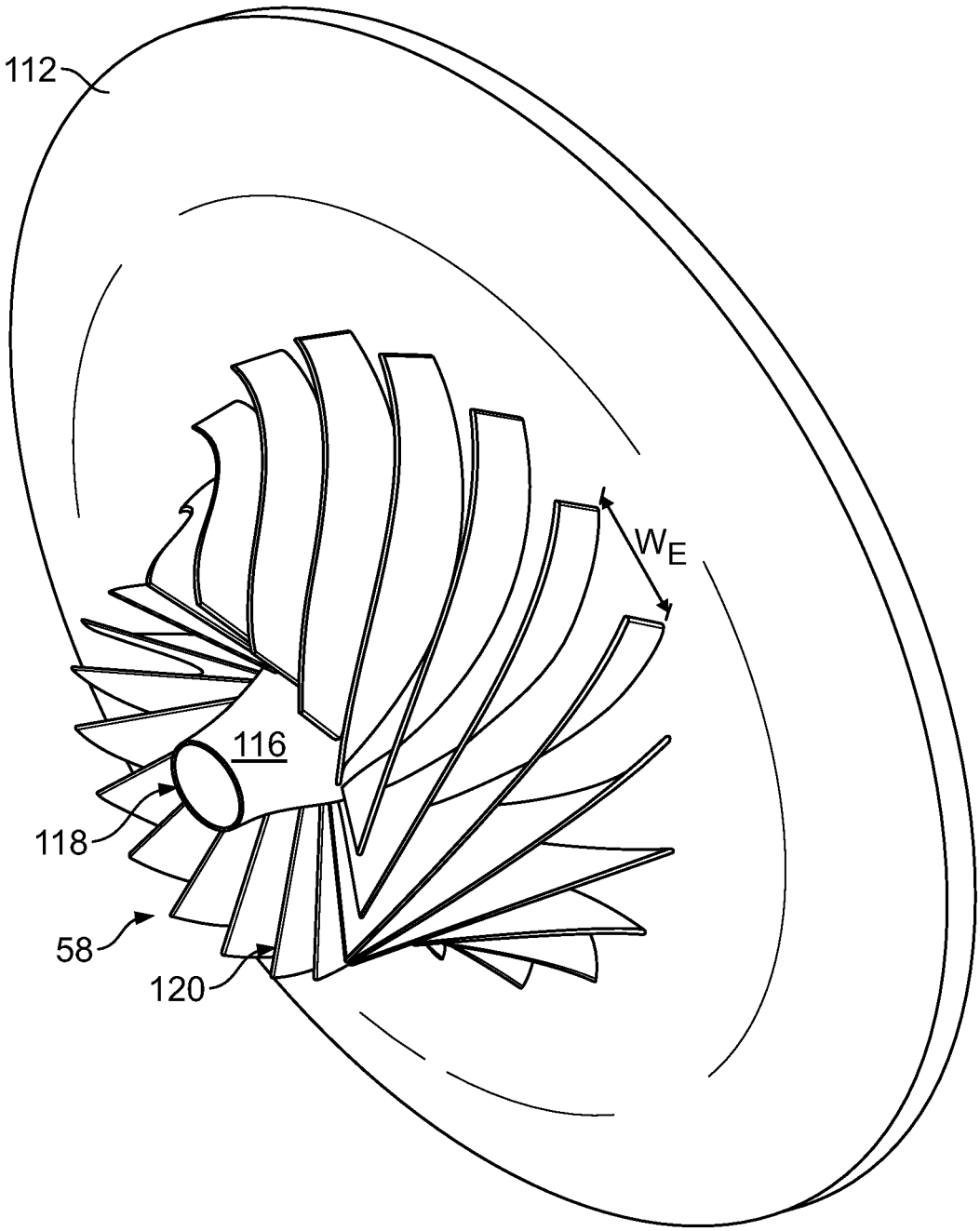
FIG. 11 illustrates a perspective view of a mixed flow impeller and diffuser with the shroud removed for a final stage compressor according to an embodiment of the present invention.

A preferred embodiment also controls the absolute flow angle entering the diffuser 112 for each target speed of each compressor stage by incorporating a variable lean back exit blade angles as a function of radius. To achieve a nearly constant relative diffusion in an embodiment of impellers 56, 58, for example, the variable impeller lean back exit blade angles for a non-final stage impeller 56 can be between about thirty-six to forty-six degrees and for a final stage impeller 58 can be between about forty to fifty degrees. Other lean back exit angles are contemplated. As illustrated in FIG. 10-11, tip width, WE, between two adjacent pluralities of impeller blades 120 can vary to control area of the impeller outlet 110.

The impellers 56, 58 have an external impeller surface 124. The external surface 124 is preferably machined or cast to less than about 125 RMS. The impellers 56, 58 have an internal impeller surface 126. The internal impeller surface 126 is preferably machined or cast to less than 125 RMS. Additionally, or alternatively, the surfaces of the impellers 56, 58 can be coated, such as with Teflon, and/or mechanically or chemically finished (or some combination thereof) to achieve the surface finish desired for the application.

In a preferred embodiment, fluid is delivered from the impellers 56, 58 and diffusers 112 to a non-final stage external volute 60 and a final stage external volute 62, respectively for each stage. The volutes 60, 62, illustrated in FIG. 1-4, are external. The volutes 60, 62 have a centroid radius that is greater than the centroid radius at the exit of the diffuser 112. Volutes 60, 62 have a curved funnel shape and increase in area to a discharge port 64 for each stage, respectively. Volutes that lie off the meridional diffuser centerline are sometimes called overhung.

The external volutes 60, 62 of this embodiment replace the conventional return channel design and are comprised of two portions—the scroll portion and the discharge conic portion. Use of volutes 60, 62 lowers losses as compared to return channels at part load and have about the same or less losses at full load. As the area of the cross-section increases, the fluid in the scroll portion of the volutes 60, 62 is at about a constant static pressure so it results in a distortion free boundary condition at the diffuser exit. The discharge conic increases pressure when it exchanges kinetic energy through the area increase.

In the case of the non-final stage compressor 26 of this embodiment, fluid is delivered from the external volute 60 to a coaxial economizer 40. In the case of the final stage compressor 28 of this embodiment, the fluid is delivered from the external volute 62 to a condenser 44 (which may be arranged coaxially with an economizer).

Turning now to the various economizers for use in the present invention, standard economizer arrangements are known and are contemplated. U.S. Pat. No. 4,232,533, assigned to the assignee of the present invention, discloses an existing economizer arrangement and function, and is incorporated herein by reference.

Some embodiments of this invention incorporate a coaxial economizer 40. Discussions directed to a preferred coaxial economizer 40 are also disclosed in co-pending application Ser. No. 12/034,551, commonly assigned to the assignee of the present invention, and are incorporated by reference. Coaxial is used in the common sense where one structure (e.g. economizer 42) has a coincident axis with at least one other structure (e.g. the condenser 44 or evaporator 22). A discussion of a preferred coaxial economizer 40 follows.

By the use of coaxial economizer 40, additional efficiencies are added to the compression process that takes place in chiller 20 and the overall efficiency of chiller 20 is increased. The coaxial economizer 40 has an economizer 42 arranged coaxially with a condenser 44. Applicants refer to this arrangement in this embodiment as a coaxial economizer 40. The coaxial economizer 40 combines multiple functions into one integrated system and further increases system efficiencies.

While economizer 42 surrounds and is coaxial with condenser 44 in a preferred embodiment, it will be understood by those skilled in the art that it may be advantageous in certain circumstances for economizer 42 to surround evaporator 22. An example of such a circumstance is one in which, due to the particular application or use of chiller 20, it is desired that evaporator 22, when surrounded by economizer 42, acts, in effect, as a heat sink to provide additional interstage cooling to the refrigerant gas flowing through coaxial economizer 40, prospectively resulting in an increase in the overall efficiency of the refrigeration cycle within chiller 20.

Figure 15:
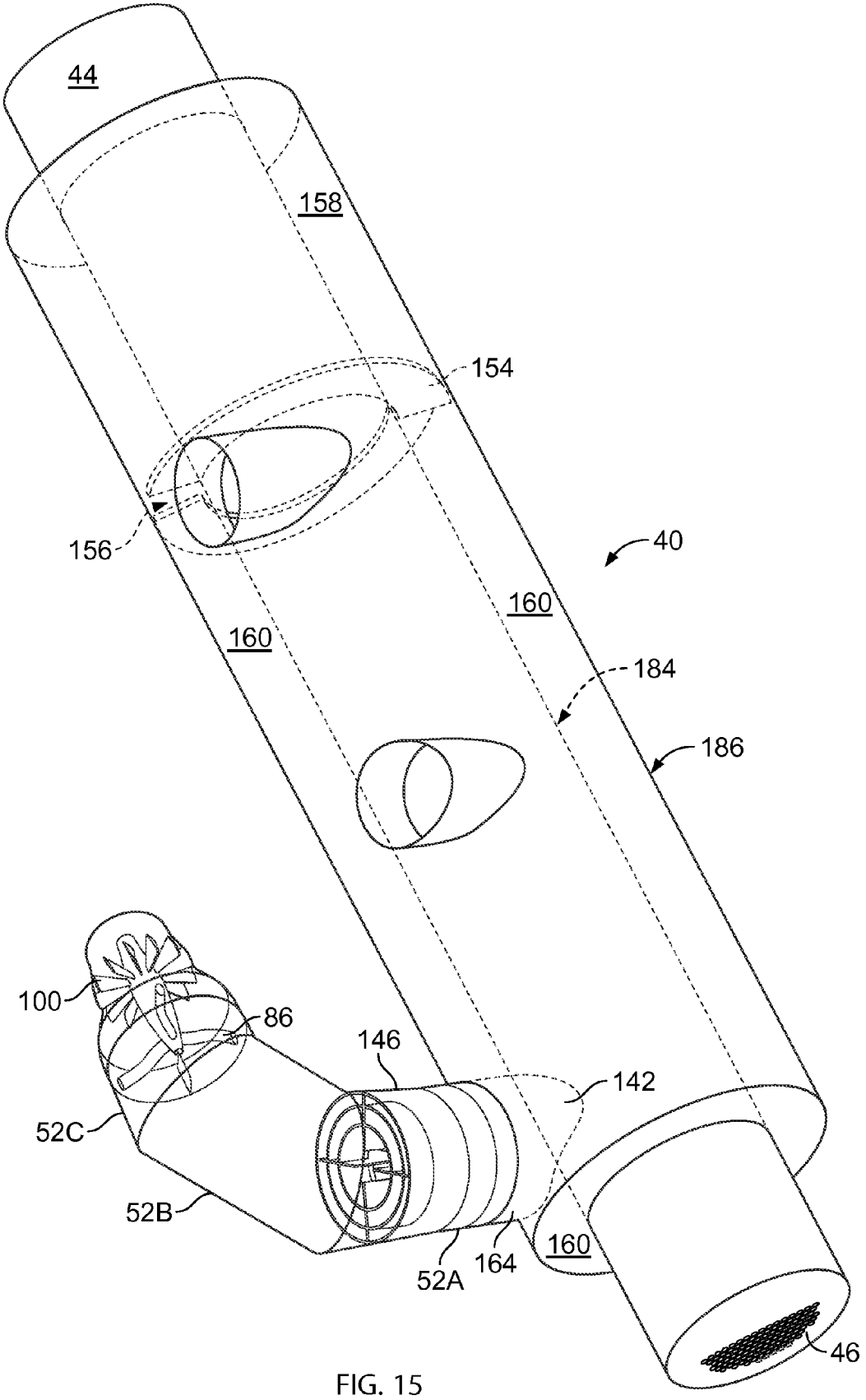
FIG. 15 illustrates a view of a swirl reducer and vortex fence positioned in a first leg of a three leg suction pipe between a conformal draft pipe attached to a coaxial economizer arrangement upstream of a final stage compressor according to an embodiment of the present invention.

As illustrated in FIGS. 2 and 15, the coaxial economizer 40 has two chambers isolated by two spiraling baffles 154. The number of baffles 154 may vary. The baffles 154 isolate an economizer flash chamber 158 and a superheat chamber 160. The economizer flash chamber 158 contains two phases of fluid, a gas and a liquid. The condenser 44 supplies liquid to the economizer flash chamber 158.

The spiraling baffles 154 depicted in FIG. 15 form a flow passage 156 defined by two injection slots. The flow passage 156 can take other forms, such as a plurality of perforations in the baffle 154. During operation, gas in the economizer flash chamber 158 is drawn out through the injection slots 156 into the superheat chamber 160. The spiraling baffles 154 are oriented so that the fluid exits through the two injection slots of the spiraling baffles 154. The fluid exits in approximately the same tangential directions as the flow discharged from the non-final stage compressor 26. The face areas of the flow passage 156 are sized to produce approximately matching velocities and flow rates in the flow passage 156 relative to the adjacent local mixing superheat chamber 160 (suction pipe side). This requires a different injection face area of the flow passage 156 based on the location of the tangential discharge conic flow, where a smaller gap results closest to the shortest path length distance, and a larger gap at the furthest path length distance. Intermediate superheat chambers 160 and flash chambers may be provided, for example, when more than two stages of compression are used.

The economizer flash chamber 158 introduces approximately 10 percent (which can be more or less) of the total fluid flow through the chiller 20. The economizer flash chamber 158 introduces lower temperature economizer flash gas with superheated gas from the discharge conic of the non-final stage compressor 26. The coaxial economizer 42 arrangement generously mixes the inherent local swirl coming out of the economizer flash chamber 158 and the global swirl introduced by the tangential discharge of the non-final stage compressor 26—discharge which is typically over the top of the outside diameter condenser 44 and the inside diameter of coaxially arranged economizer 42.

The liquid in chamber 162 is delivered to the evaporator 22. This liquid in the bottom portion of the economizer flash chamber 158 is sealed from the superheat chamber 160. Sealing of liquid chamber 162 can be sealed by welding the baffle 154 to the outer housing of the coaxially arranged economizer 42. Leakage is minimized between other mating surfaces to less than about 5 percent.

In addition to combining multiple functions into one integrated system, the coaxial economizer 40 produces a compact chiller 20 arrangement. The arrangement is also advantageous because the flashed fluid from the economizer flash chamber 158 better mixes with the flow from the non-final stage compressor 26 than existing economizer systems, where there is a tendency for the flashed economizer gas not to mix prior to entering a final stage compressor 28. In addition, the coaxial economizer 40 dissipates local conic discharge swirl as the mixed out superheated gas proceeds circumferentially to the final stage compressor 28 to the tangential final stage suction inlet 52. Although some global swirl does exist at the entrance to the final stage suction pipe 52, the coaxial economizer 40 reduces the fluid swirl by about 80 percent compared to the non-final stage compressor 26 conic discharge swirl velocity. Remaining global swirl can be optionally reduced by adding a swirl reducer or deswirler 146 in the final stage suction pipe 52.

Turning to FIG. 15, a vortex fence 164 may be added to control strong localized corner vortices in a quadrant of the conformal draft pipe 142. The location of the vortex fence 164 is on the opposite side on the most tangential pick up point of the coaxially arranged economizer 42 and the conformal draft pipe 142. The vortex fence 164 is preferably formed by a sheet metal skirt projected from the inner diameter of the conformal draft pipe 142 (no more than a half pipe or 180 degrees is required) and bounds a surface between the outside diameter 184 of the condenser 44 and inner diameter 186 of the coaxially arranged economizer 42. The vortex fence 164 eliminates or minimizes corner vortex development in the region of the entrance of the draft pipe 142. The use of a vortex fence 164 may not be required where a spiral draft pipe 142 wraps around a greater angular distance before feeding the inlet flow conditioning assembly 54.

Figure 12:
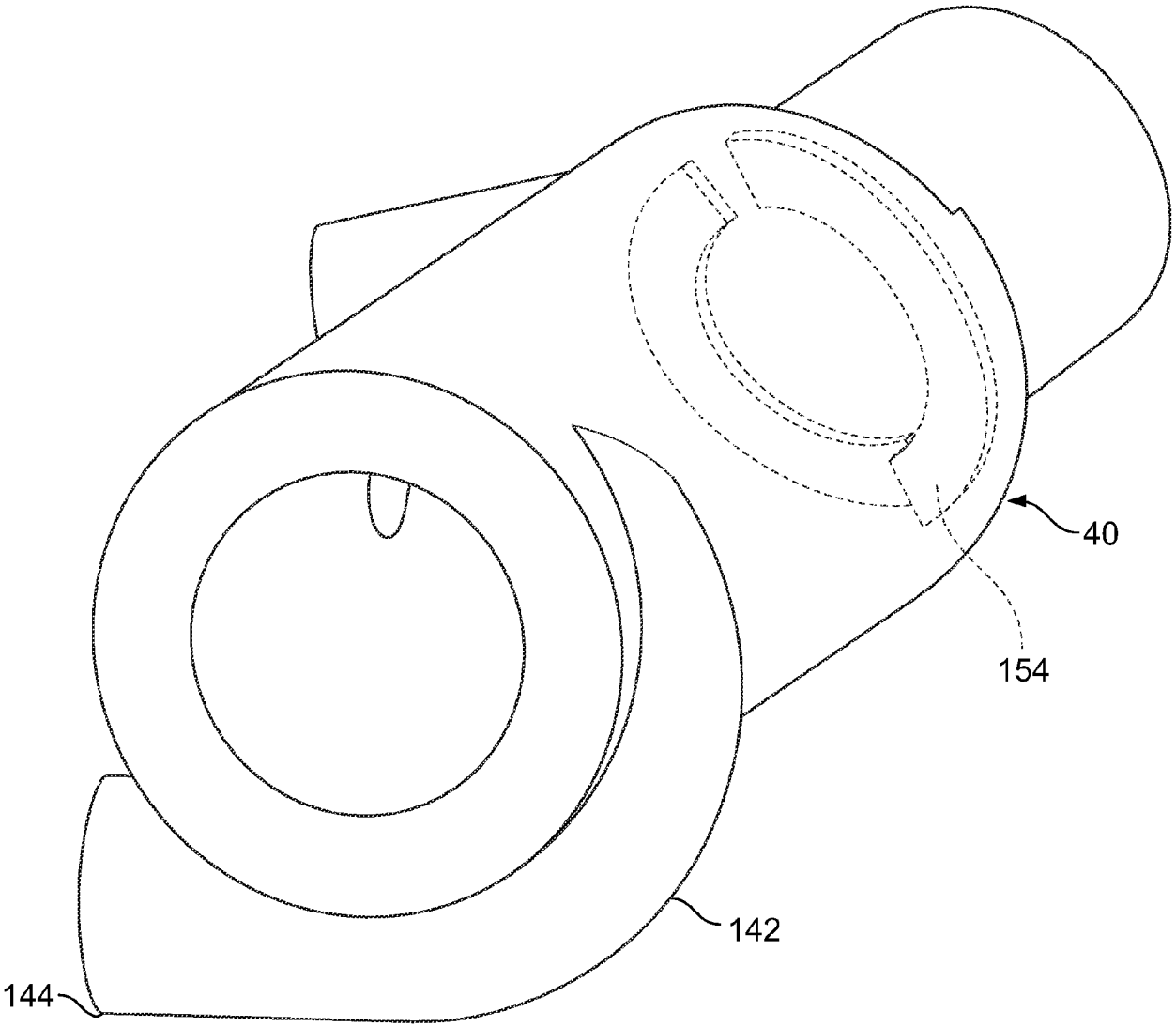
FIG. 12 illustrates a perspective view of a conformal draft pipe attached to a coaxial economizer arrangement according to an embodiment of the present invention.

From the coaxial economizer 40 of this embodiment, the refrigerant vapor is drawn by final stage impeller 58 of the final stage compressor 28 and is delivered into a conformal draft pipe 142. Referring to FIG. 12, the conformal draft pipe 142 has a total pipe wrap angle of about 180 degrees, which is depicted as starting from where the draft pipe 142 changes from constant area to where it has zero area. The draft pipe exit 144 of the draft pipe 142 has an outside diameter surface that lies in the same plane as the inner diameter of the condenser 44 of the coaxially arranged economizer 42. Conformal draft pipe 142 achieves improved fluid flow distribution, distortion control and swirl control entering a later stage of compression.

Conformal draft pipe 142 can have multiple legs. Use of multiple legs may be less costly to produce than a conformal draft pipe 142 as depicted in FIG. 12. Use of such a configuration has a total pipe wrap angle that is less than 90 degrees, which starts from about where projected pipe changes from constant area to a much reduced area. A draft pipe 142 with multiple legs achieves about 80 percent of the idealized pipe results for distribution, distortion and swirl control.

Referring still to FIG. 15, fluid is delivered from the draft pipe 142 to a final stage suction pipe 52. The final stage suction pipe 52 is similarly, if not identically, configured to the inlet suction pipe 50. As discussed, the suction pipe 50, 52 can be a three-piece elbow. For example, the illustrated final suction pipe 52 has a first leg 52A, section leg 52B, and a third leg 52C.

Optionally, a swirl reducer or deswirler 146 may be positioned within the final stage suction pipe 52. The swirl reducer 146 may be positioned in the first leg 52A, second leg 52B, or third leg 52C. Referring to FIGS. 10 and 11, an embodiment of the swirl reducer 146 has a flow conduit 148 and radial blades 150 connected to the flow conduit 148 and the suction pipe 50, 52. The number of flow conduits 148 and radial blades 150 varies depending on design flow conditions. The flow conduit 148 and radial blade 150, cambered or uncambered, form a plurality of flow chambers 152. The swirl reducer 146 is positioned such that the flow chambers 152 have a center coincident with the suction pipe 50, 52. The swirl reducer 146 swirling upstream flow to substantially axial flow downstream of the swirl reducer 146. The flow conduit 148 preferably has two concentric flow conduits 148 and are selected to achieve equal areas and minimize blockage.

The number of chambers 152 is set by the amount of swirl control desired. More chambers and more blades produce better deswirl control at the expense of higher blockage. In one embodiment, there are four radial blades 150 that are sized and shaped to turn the tangential velocity component to axial without separation and provide minimum blockage.

The location of the swirl reducer 146 may be located elsewhere in the suction pipe 52 depending on the design flow conditions. As indicated above, the swirl reducer 146 may be placed in the non-final stage suction pipe 50 or final stage suction pipe 52, both said pipes, or may not be used at all.

Also, the outside wall of the swirl reducer 146 can coincide with the outside wall of the suction pipe 52 and be attached as shown in FIGS. 13 and 14. Alternatively, the one or more flow conduits 148 and one or more radial blades 150 can be attached to an outside wall and inserted as a complete unit into suction pipe 50, 52.

As illustrated in FIG. 13, a portion of radial blade 150 extends upstream beyond the flow conduit 148. The total chord length of the radial blade 150 is set in one embodiment to approximately one-half of the diameter of the suction pipe 50, 52. The radial blade 150 has a camber roll. The camber roll of the radial blade 150 rolls into the first about forty percent of the radial blade 150. The camber roll can vary. The camber line radius of curvature of the radial blade 150 is set to match flow incidence. One may increase incidence tolerance by rolling a leading edge circle across the span of the radial blade 150.

FIG. 14 depicts an embodiment of the discharge side of the swirl reducer 146. The radial uncambered portion of the radial blade 150 (no geometric turning) is trapped by the concentric flow conduits 148 at about sixty percent of the chord length of the radial blade 150.

The refrigerant exits the swirl reducer 146 positioned in the final stage suction pipe 52 and is further drawn downstream by the final stage compressor 28. The fluid is compressed by the final stage compressor 28 (similar to the compression by the non-final stage compressor 26) and discharged through the external volute 62 out of a final stage compressor outlet 34 into condenser 44. Referring to FIG. 2, the conic discharge from the final stage compressor 28 enters into the condenser approximately tangentially to the condenser tube bundles 46.

Turning now to the condenser 44 illustrated in FIGS. 1-3 and 15, condenser 44 can be of the shell and tube type, and is typically cooled by a liquid. The liquid, which is typically city water, passes to and from a cooling tower and exits the condenser 44 after having been heated in a heat exchange relationship with the hot, compressed system refrigerant, which was directed out of the compressor assembly 24 into the condenser 44 in a gaseous state. The condenser 44 may be one or more separate condenser units. Preferably, condenser 44 may be a part of the coaxial economizer 40.

The heat extracted from the refrigerant is either directly exhausted to the atmosphere by means of an air cooled condenser, or indirectly exhausted to the atmosphere by heat exchange with another water loop and a cooling tower. The pressurized liquid refrigerant passes from the condenser 44 through an expansion device such as an orifice (not shown) to reduce the pressure of the refrigerant liquid.

The heat exchange process occurring within condenser 44 causes the relatively hot, compressed refrigerant gas delivered there to condense and pool as a relatively much cooler liquid in the bottom of the condenser 44. The condensed refrigerant is then directed out of condenser 44, through discharge piping, to a metering device (not shown) which, in a preferred embodiment, is a fixed orifice. That refrigerant, in its passage through metering device, is reduced in pressure and is still further cooled by the process of expansion and is next delivered, primarily in liquid form, through piping back into evaporator 22 or economizer 42, for example.

Metering devices, such as orifice systems, can be implemented in ways well known in the art. Such metering devices can maintain the correct pressure differentials between the condenser 44, economizer 42 and evaporator 22 of the entire range of loading.

In addition, operation of the compressors, and the chiller system generally, is controlled by, for example, a microcomputer control panel 182 in connection with sensors located within the chiller system that allows for the reliable operation of the chiller, including display of chiller operating conditions. Other controls may be linked to the microcomputer control panel, such as: compressor controls; system supervisory controls that can be coupled with other controls to improve efficiency; soft motor starter controls; controls for regulating guide vanes 100 and/or controls to avoid system fluid surge; control circuitry for the motor or variable speed drive; and other sensors/controls are contemplated as should be understood. It should be apparent that software may be provided in connection with operation of the variable speed drive and other components of the chiller system 20, for example.

It will be readily apparent to one of ordinary skill in the art that the centrifugal chiller disclosed can be readily implemented in other contexts at varying scales. Use of various motor types, drive mechanisms, and configurations with embodiments of this invention should be readily apparent to those of ordinary skill in the art. For example, embodiments of multi-stage compressor 24 can be of the direct drive or gear drive type typically employing an induction motor.

Chiller systems can also be connected and operated in series or in parallel (not shown). For example, four chillers could be connected to operate at twenty five percent capacity depending on building load and other typical operational parameters.

The patentable scope of the invention is defined by the claims as described by the above description. While particular features, embodiments, and applications of the present invention have been shown and described, including the best mode, other features, embodiments or applications may be understood by one of ordinary skill in the art to also be within the scope of this invention. It is therefore contemplated that the claims will cover such other features, embodiments or applications and incorporates those features which come within the spirit and scope of the invention.

We claim:

1. An inlet flow conditioning assembly for use in a centrifugal compressor to control aerodynamic blockage, distribution, and swirl of a refrigerant, comprising:

a. an inlet flow conditioning housing positioned within the compressor the inlet flow conditioning housing upstream of an impeller housed in the compressor; said impeller having impeller blades with leading edges; the inlet flow conditioning housing forming a flow conditioning channel axially extending from a channel inlet to a channel outlet;

b. a flow conditioning body having a first body end with a first body end radius, an intermediate portion with a body radius and a second body end with a second body end radius; said flow conditioning body being substantially centrally positioned along a length of the flow conditioning channel; the flow conditioning body is arranged coincident to a flow conditioning nose at the first body end and coincident to the impeller hub of the impeller at the second body end, said flow conditioning body having a streamline curvature where the body radius relative to an axis of rotation of the impeller that exceeds a radius of the impeller hub and where the first body end radius and second body radius are less than the body radius;

c. a plurality of inlet guide vanes positioned between said channel inlet and channel outlet; said plurality of inlet guide vanes being rotatably mounted on a support shaft at a location along the flow conditioning body where the body radius relative to the axis of rotation of the impeller exceeds the radius of the impeller hub; and d. a strut including a first strut end and a second strut end, the first strut end being attached at the flow conditioning nose and the second strut end being attached to the inlet flow conditioning housing, and the strut designed to have a substantially s-shape in a plane substantially parallel to the channel inlet, wherein the flow conditioning body, the flow conditioning nose and the plurality of inlet guide vanes are axially spaced along and relative to the flow conditioning channel to condition the refrigerant in the flow conditioning channel such that leading edges of the plurality of inlet guide vanes, in a fully open position, are aligned with a primarily axial flow distribution of the refrigerant in the fluid conditioning channel at and upstream of the plurality of inlet guide vanes and the plurality of inlet guide vanes, in a fully open position, impart on the primarily axial flow distribution of refrigerant, from the leading edges of the plurality of inlet guide vanes to trailing edges of the plurality of inlet guide vanes, a non-zero target swirl distribution, in a range between about 0 degrees to about 20 degrees, on the refrigerant flowing into leading edges of the impeller blades.

2. The inlet flow conditioning assembly of claim 1 wherein the strut has a strut mean camber line aligned in a flow direction plane of the channel inlet.

3. The inlet flow conditioning assembly of claim 1 wherein the strut has a symmetric thickness distribution around a mean camber line of the strut in a flow direction plane of the channel inlet.

4. The inlet flow conditioning assembly of claim 1 wherein the ratio of maximum radius of the flow conditioning body to the radius of the impeller hub is about 2 to 1.

5. The inlet flow conditioning assembly of claim 1 wherein the second body intermediate portion has a radius extending from the axis of rotation of the impeller larger than the first body end radius and the third body end radius.

6. The inlet flow conditioning assembly of claim 1 wherein the plurality of inlet guide vanes have a shroud side edge surface shaped to conform to a surface curvature of the flow conditioning body.

7. The inlet flow conditioning assembly of claim 1 wherein the inlet flow conditioning housing has a depressed surface shape; the plurality of inlet guide vanes have a shroud side edge surface shape, said shroud side edge surface shape conforms to the depressed surface shape.

8. The inlet flow conditioning assembly of claim 7 wherein the shape of the shroud side edge surface of the plurality of inlet guide vanes and the shape of the depressed surface of the inlet flow conditioning housing are substantially spherical such that the shroud side edge surface of the plurality of inlet guide vanes nests in the depressed surface of the inlet flow conditioning housing.

9. The inlet flow conditioning assembly of claim 1 wherein the plurality of inlet guide vanes are cambered airfoils.

10. The inlet flow conditioning assembly of claim 1 wherein the plurality of inlet guide vanes are configured with a radially varying camber with a symmetrical thickness.

11. The inlet flow conditioning assembly of claim 1 wherein the plurality of inlet guide vanes are configured with a variable spanwise camber and arranged to impart greater than 0 to about 20 degrees of swirl upstream of the impeller with a minimum total pressure loss of the compressor after the refrigerant passes through the plurality of inlet guide vanes.

12. The inlet flow conditioning assembly of claim 11 wherein the plurality of inlet guide vanes are arranged to impart about a constant radial 12 degrees of swirl at the impeller.

13. The inlet flow conditioning assembly of claim 1 wherein the plurality of inlet guide vanes comprising a plurality of blades arranged in a fully open position with a leading edge of the plurality of blades aligned with a flow direction of the refrigerant and with a trailing edge of the plurality of blades having radially varying camber from a hub side to a shroud side of the plurality of inlet guide vanes such that the plurality of inlet guide vanes impart up to about 20 degree swirl upstream of the impeller with a minimum total pressure loss of the compressor through the plurality of inlet guide vanes.

14. The inlet flow conditioning assembly of claim 1 wherein the plurality of inlet guide vanes are positioned at a location on the flow conditioning body where the radius of the flow conditioning body extending from the axis of rotation of the impeller is largest along the flow conditioning body.

15. The inlet flow conditioning assembly of claim 1 wherein the inlet flow conditioning assembly is located downstream of a swirl reducer.

16. The inlet flow conditioning assembly of claim 15 wherein the swirl reducer comprises:

a flow conduit being positioned upstream of the compressor; a radial blade connected to the flow conduit and a suction pipe; the flow conduit and the radial blade forming a plurality of flow chambers having a center coincident with the suction pipe and being configured such that the refrigerant having a swirling flow upstream of the flow chambers has a substantially axial flow downstream of the flow chambers.

17. A method of controlling aerodynamic blockage, distribution and swirl of the refrigerant through a centrifugal compressor having a compressor housing, said compressor for compressing a refrigerant, comprising the steps of:

a. positioning an inlet flow conditioning assembly upstream of an impeller disposed within the compressor housing said inlet flow conditioning assembly further comprising:

i. an inlet flow conditioning housing positioned within the compressor the inlet flow conditioning housing upstream of an impeller housed in the compressor; said impeller having impeller blades with leading edges; the inlet flow conditioning housing forming a flow conditioning channel axially extending from a channel inlet to a channel outlet;

ii. a flow conditioning body having a first body end with a first body end radius, an intermediate portion with a body radius and a second body end with a second body end radius; said flow conditioning body being substantially centrally positioned along a length of the flow conditioning channel; the flow conditioning body is arranged coincident to a flow conditioning nose at the first body end and coincident to the impeller hub of the impeller at the second body end, said flow conditioning body having a streamline curvature where the body radius relative to an axis of rotation of the impeller that exceeds a radius of the impeller hub and where the first body end radius and second body radius are less than the body radius;

iii. a plurality of inlet guide vanes positioned between said channel inlet and channel outlet; said plurality of inlet guide vanes being rotatably mounted on a support shaft at a location along the flow conditioning body where the radius relative to the axis of rotation of the impeller exceeds the radius of the impeller hub; and iv. a strut including a first strut end and a second strut end, the first strut end being attached at the flow conditioning nose and the second strut end being attached to the inlet flow conditioning housing, and the strut designed to have a substantially s-shape in a plane substantially parallel to the channel inlet and b. drawing the refrigerant through said inlet flow conditioning assembly to the impeller during operation of the compressor, wherein the flow conditioning body, the flow conditioning nose and the plurality of inlet guide vanes are axially spaced along and relative to the flow conditioning channel to condition the refrigerant in the flow conditioning channel such that leading edges of the plurality of inlet guide vanes, in a fully open position, are aligned with a primarily axial flow distribution of the refrigerant in the fluid conditioning channel at and upstream of the plurality of inlet guide vanes and the plurality of inlet guide vanes, in a fully open position, impart on the primarily axial flow distribution of refrigerant, from the leading edges of the plurality of inlet guide vanes to trailing edges of the plurality of inlet guide vanes, a non-zero target swirl distribution, in a range between about 0 degrees to about 20 degrees, on the refrigerant flowing into leading edges of the impeller blades.

18. The method of conditioning of claim 17 wherein the plurality of inlet guide vanes are located at a position where the radius of the flow conditioning body is largest.

19. The method of conditioning of claim 17 further comprising the step of discharging the refrigerant from the impeller to a diffuser in fluid communication with an external volute; said external volute forming a circumferential flow path around said compressor housing; said external volute having a centroid radius greater than a centroid radius of the diffuser.

20. The method of conditioning of claim 17 further comprising the step of positioning a swirl reducer upstream of the inlet flow conditioning assembly; wherein the swirl reducer further comprises:

a flow conduit; a radial blade connected to the flow conduit and a suction pipe for delivering the refrigerant to the compressor; the flow conduit and the radial blade forming a plurality of flow chambers having a center coincident with the suction pipe and being sized such that the refrigerant having a swirling flow upstream of the flow chambers has a substantially axial flow downstream of the flow chambers.

21. The method of condition of claim 20 wherein the drawing step further comprises drawing the refrigerant through a swirl reducer then through said inlet flow conditioning assembly.

22. An inlet flow conditioning assembly for use in a variable speed compressor to control aerodynamic blockage, distribution, and swirl of a refrigerant, comprising:

a. an inlet flow conditioning housing positioned within a compressor the inlet flow conditioning housing upstream of an impeller housed in the compressor; the impeller having impeller blades with a hub, mid, and shroud radii; the inlet flow conditioning housing forming a flow conditioning channel axially extending from a channel inlet to a channel outlet;

b. a flow conditioning body having a first body end with a first body end radius, an intermediate portion with a body radius and a second body end with a second body end radius; said flow conditioning body being substantially centrally positioned along a length of the flow conditioning channel; the flow conditioning body is arranged coincident to a flow conditioning nose at the first body end and coincident to the impeller hub of the impeller at the second body end, said flow conditioning body having a streamline curvature where the body radius relative to an axis of rotation of the impeller that exceeds a radius of the impeller hub and where the first body end radius and second body radius are less than the body radius;

c. a plurality of inlet guide vanes positioned between said channel inlet and channel outlet; said plurality of inlet guide vanes having hub, mid, and shroud radii greater than the impeller blades hub, mid, and shroud radii and said plurality of inlet guide vanes being rotatably mounted on a support shaft at a location along the flow conditioning body where the radius relative to the axis of rotation of the impeller exceeds the radius of the impeller hub; and d. a strut including a first strut end and a second strut end, the first strut end being attached at the flow conditioning nose and the second strut end attached to the inlet flow conditioning housing, the strut being configured to distribute wake across more than one row of the plurality of inlet guide vanes, and the strut having a substantially s-shape in a plane substantially parallel to said channel inlet wherein the flow conditioning body, the flow conditioning nose and the plurality of inlet guide vanes are axially spaced along and relative to the flow conditioning channel to condition the refrigerant in the flow conditioning channel such that leading edges of the plurality of inlet guide vanes, in a fully open position, are aligned with a primarily axial flow distribution of the refrigerant in the fluid conditioning channel at and upstream of the plurality of inlet guide vanes and the plurality of inlet guide vanes, in a fully open position, impart on the primarily axial flow distribution of refrigerant, from the leading edges of the plurality of inlet guide vanes to trailing edges of the plurality of inlet guide vanes, a non-zero target swirl distribution, in a range between about 0 degrees to about 20 degrees, on the refrigerant flowing into leading edges of the impeller blades.

* * * * *